US005620190A

United States Patent [19]

Maggiore

[11] Patent Number: 5,620,190

[45] Date of Patent: Apr. 15, 1997

[54] IN-LINE SKATE

[75] Inventor: Albert P. Maggiore, Lancaster, N.Y.

[73] Assignee: Fisher-Price, Inc., East Aurora, N.Y.

[21] Appl. No.: 292,030

[22] Filed: Aug. 18, 1994

[51] Int. Cl.[6] ..... A63C 17/06; A63C 17/14; A63C 17/20

[52] U.S. Cl. ..... 280/11.21; 280/11.22; 280/11.26; 280/11.27; 280/7.1

[58] Field of Search ..... 280/11.19, 11.21, 280/11.22, 11.23, 11.26, 11.27, 7.1, 7.13

[56] References Cited

U.S. PATENT DOCUMENTS

| | | | |
|---|---|---|---|
| 542 | 2/1837 | Lowry . | |
| 15,172 | 2/1856 | Atton . | |
| Re. 32,346 | 3/1987 | Klamer et al. | 280/11.2 |
| 87,225 | 2/1869 | Topliff et al. | 280/247 |
| D. 167,697 | 9/1952 | Kosack | D90/8 |
| D. 168,202 | 11/1952 | Wilkens | D34/15 |
| D. 173,777 | 1/1955 | Abel | D90/8 |
| D. 217,525 | 5/1970 | Takashima | D90/8 |
| 296,833 | 4/1884 | Hanlon | 280/11.21 |
| 301,676 | 7/1884 | Clark | 280/11.19 |
| 308,744 | 12/1884 | Brix . | |
| 363,716 | 5/1887 | Yost | 280/11.21 |
| 566,071 | 8/1896 | Flatt | 280/304 |
| 708,809 | 9/1902 | Hayes | 280/296 |
| 864,334 | 8/1907 | Pilz | 280/11.21 |
| 1,188,377 | 6/1916 | Weaver | 280/11.27 |
| 1,434,701 | 11/1922 | Hurdry | 280/7.15 |
| 1,517,352 | 12/1924 | Foote | 280/11.21 X |
| 1,974,152 | 3/1934 | Draws | 280/11.2 |
| 2,070,646 | 2/1937 | Blochinger | 208/173 |
| 2,209,804 | 7/1940 | Ashley | 280/96.2 |
| 2,212,741 | 8/1940 | Johnson | 280/7.1 |
| 2,218,510 | 10/1940 | Albertson et al. | 180/25 |
| 2,450,979 | 10/1948 | Moller | 280/293 |
| 2,458,127 | 1/1949 | Ahrens | 280/7.1 |
| 2,540,847 | 2/1951 | Thorson | 280/11.26 X |
| 2,570,349 | 10/1951 | Kardhordo | 280/11.22 |
| 2,647,764 | 8/1953 | Anderson | 280/293 |
| 3,000,643 | 9/1961 | Levin | 280/11.2 |
| 3,401,954 | 9/1968 | Brilando | 280/293 |
| 3,790,187 | 2/1974 | Radu et al. | 280/11.2 |
| 3,823,952 | 7/1974 | Kukulowicz | 280/11.2 |
| 3,837,662 | 9/1974 | Marks et al. | 280/11.23 |
| 3,900,203 | 8/1975 | Kukulowicz | 280/11.2 |
| 3,901,520 | 8/1975 | McMahan | 280/11.19 X |
| 3,963,252 | 6/1976 | Carlson | 280/11.22 |
| 4,058,324 | 11/1977 | Dallaire | 280/11.22 |
| 4,079,957 | 3/1978 | Blease | 280/278 |
| 4,326,729 | 4/1982 | Luckowski et al. | 280/304 |

(List continued on next page.)

FOREIGN PATENT DOCUMENTS

| | | |
|---|---|---|
| 1402028 | 8/1975 | United Kingdom . |
| 1497546 | 1/1978 | United Kingdom . |

*Primary Examiner*—Brian L. Johnson
*Attorney, Agent, or Firm*—Howrey & Simon; C. Scott Talbot; Melvin L. Barnes, Jr.

[57] ABSTRACT

An in-line roller skate for use by children has a stability enhancing mechanism and a movement limiting mechanism. The stability enhancing mechanism includes two rollers, mounted on an axle, that are selectively positionable side-by-side in a normal mode or spaced apart in a stable mode. A combine arm having two fingers pivots downward to cam the rollers inward from the stable to the normal mode. Alternately, a separator arm pivots downward to slide the two rollers apart on the axle from the normal mode to the stable mode. The movement limiting mechanism includes a roller, mounted on an axle, that has teeth formed on the radially inner surface of the cylindrical outer portion. A pawl has a pawl arm extending into the inner cylindrical portion of the roller to engage the teeth and a pawl tongue that extends into a pawl adjuster. The pawl adjuster has a retaining slot and is slidably positioned in a well in the front chassis of the skate to cam the pawl up into a nonengaging position, corresponding to the free wheeling mode. The pawl adjuster can also be positioned to allow the pawl to ride on the teeth of the roller, corresponding to the forward only mode, or to restrain the pawl in the engaging position, corresponding to the full stop mode.

27 Claims, 48 Drawing Sheets

U.S. PATENT DOCUMENTS

| | | | |
|---|---|---|---|
| 4,350,222 | 9/1982 | Lutteke et al. | 180/209 |
| 4,453,726 | 6/1984 | Ziegler | 280/11.2 |
| 4,512,590 | 4/1985 | Stenvall | 280/11.23 |
| 4,553,767 | 11/1985 | Robjent et al. | 280/11.21 |
| 4,666,168 | 5/1987 | Hamill et al. | 280/11.2 |
| 4,666,169 | 5/1987 | Hamill et al. | 280/11.23 |
| 4,708,352 | 11/1987 | Vullierme | 280/11.26 |
| 4,932,676 | 6/1990 | Klamer | 280/11.21 X |
| 5,088,748 | 2/1992 | Koselka et al. | 280/11.2 |
| 5,133,569 | 7/1992 | Rieber et al. | 280/293 |
| 5,135,244 | 8/1992 | Allison | 280/11.28 |
| 5,143,387 | 9/1992 | Colla | 280/11.2 |
| 5,171,032 | 12/1992 | Dettmer | 280/11.2 |
| 5,183,276 | 2/1993 | Pratt | 280/11.22 |
| 5,192,099 | 3/1993 | Riutta | 280/11.2 |
| 5,295,701 | 3/1994 | Reiber et al. | 280/11.22 |
| 5,372,534 | 12/1994 | Levy et al. | 280/11.22 X |
| 5,421,596 | 6/1995 | Lee | 280/11.26 X |
| 5,449,183 | 9/1995 | Klamer et al. | 280/11.27 |

IN-LINE SKATE

BACKGROUND OF THE INVENTION

The invention relates to an in-line roller skate and specifically to an in-line roller skate for use by children that selectively provides enhanced lateral stability and user control of the direction of movement of the skate. The skate has a roller assembly configurable between a normal mode in which both halves of the roller are abutting and a stable mode in which the halves are spaced apart to enhance the lateral stability of the skate. The skate also as a roller assembly that is configurable to either a free wheeling, a forward only, or a full stop configuration, therefore limiting the direction of movement of the skate.

Roller skates typically consist of a boot portion attached to a sole portion supported by a set of rollers. Conventional four wheel roller skates have a pair of front rollers sharing one axis of rotation and a pair of rear rollers sharing a second axis of rotation that is parallel to the axis of rotation of the front rollers. Since the rollers of each pair are transversely displaced from the longitudinal center-line of the roller skate, the conventional roller skate inherently provides substantial lateral stability.

In contrast, in-line roller skates typically have from three to six rollers arranged in longitudinal alignment along the longitudinal center-line of the skate. Each roller has an unique axis of rotation that is parallel to the axes of rotation of the other rollers. Since none of the rollers are transversely displaced from the longitudinal center-line of the skate, the in-line skate provides very little inherent lateral stability.

Roller skating on in-line skates, which simulates the fed and motion of skating on ice while using a conventional ice skate, has become quite popular. However as discussed, since the in-line skate has a row of longitudinally aligned rollers, it does not have the inherent stability of a conventional four wheel roller skate. Consequently many people, especially children, have difficulty keeping their balance while using in-line roller skates. Furthermore, ice skating normally takes place on a substantially planar surface while roller skating takes place on land, which may include hills having a wide range of gradients thus making mastery of the in-line roller skate even more difficult.

One proposed method of creating additional lateral stability in an in-line skate is to place a roller in a position that is transversely displaced from the longitudinal center-line of the skate. This can be accomplished by moving an existing roller or adding an additional roller at the desired location. Although this method does provide enhanced stability should the skate tilt towards the transversely displace roller, no additional stability is provided should the skate tilt away from the roller. Hence, this method provides enhanced lateral stability in only one direction with respect to the longitudinal center-line of the skate.

Several such in-line roller skates have been proposed that provide added lateral stability to the skate. U.S. Pat. No. 5,295,701 to Reiber et al. discloses an in-line skate having a center roller that is alternatively positionable in a longitudinally aligned position relative to the front and rear rollers or a transversely displaced position relative to the other rollers. Hence, the lateral stability of the skate is increased by moving the center roller out of alignment with respect to the other rollers. As discussed above however, the stability of the skate is enhanced only in the direction in which the center roller is displaced.

U.S. Pat. No. 5,183,276 to Pratt discloses an in-line skate having a removable training roller. The roller is housed in a U-shaped training bracket so that the training roller has an axis of rotation that is parallel with the axis of rotation of the other rollers and transversely displaced from the longitudinal center-line of the skate. The training roller engages the travel surface when the skate engages the travel surface at an acute angle. Therefore, the design provides for increased stability only when the skate is tilted towards the travel surface in the direction of the training roller such as when making a sharp turn. Furthermore, this device requires significant assembly and disassembly to convert between the normal in-line skate and training skate configurations.

The skate disclosed in U.S. Pat. No. 3,901,520 to McMahan, is configurable as a two wheel in-line skate or a four wheel conventional roller skate. To convert from an in-line to a conventional skate, the operator removes roller 17 from between channel walls 16 and installs two rollers 17, one positioned on the outside of each channel wall 16 as shown in FIG. 4. Reconfiguring the skate requires the removal of the entire roller assembly and thus requires more time and effort than most children are willing to expend.

U.S. Pat. No. 87,225 to Topliff and Ely discloses a bicycle having two rear wheels that can be positioned apart from each other for increased stability, or together constituting a single rear wheel. Configuration of the wheel is accomplished by rotating a V-shaped rear axle. When the axle's middle is higher than its ends, the rear wheels will move toward the middle of the axle to act as a single wheel. When the axle is rotated so that its ends are higher than the middle, the wheels will slide along the axle toward the ends to provide the greater stability of a tricycle. As can be seen in FIG. 2, this system works best when each half of the axle is substantially longer than the thickness of the wheel. This design is not readily adaptable to a roller skate because the small diameter of the roller would make the change in height of the roller skate noticeable to the user.

Another desirable feature of an in-line skate adapted for use with children or inexperienced adults is to incorporate a movement limiting device. By limiting the rotation of one or more rollers to one rotative direction (corresponding to forward movement of the skate), the frictional forces provided by the skate, should the skate be urged in the backward direction, would allow the user to generate the desired propulsion by pushing straight back on the skate (rather than having to angle the skate to the side). In addition, this configuration allows the user to skate up a sloping travel surface without the fear of inadvertently rolling backwards down the slope. Furthermore, by configuring the skate so that one or more rollers cannot rotate in either direction prevents movement of the skate in either the forward or backward direction. In this configuration, the user can "walk" in the skates to get more comfortable with wearing and keeping his balance in the skates.

Unlike a conventional roller skate, the movement limiting mechanism in an in-line skate should be laterally compact so that exposed components do not reduce the aesthetics of the skate. More importantly, a laterally compact design reduces exposure of the components, thus reducing the vulnerability and increasing the reliability of the mechanism.

With regard to controlling the rotational motion of skate wheels, U.S. Pat. No. 4,932,676 to Klamer discloses a design for a conventional roller skate that is configurable between a free wheeling, forward only, or full stop configuration. A pair of rollers have gear-like teeth 80 on the inside cylindrical surfaces of the rollers. Camming member 130 positions pawl 100 to selectively engage teeth 80 and therefore control the movement of the rollers. Since the pawl extends across the body of the skate to engage both rollers, and the camming member engages the pawl intermediate the rollers, this design is not well suited for use in an in-line skate.

Another known design for wheel motion control in an in-line skate is to mount a knurled rod for selective engagement with the outside rolling surface of one of the wheels. The rod can be manually moved between a position in which the rod locks the wheel against rearward rotation while permitting forward rotation, and a position in which the rod does not engage the wheel. This design does not provide for engagement of the wheel to prevent rotation in both directions.

SUMMARY OF THE INVENTION

The drawbacks of the prior art are overcome by the present invention, which provides an in-line skate for use by children having a stability enhancing mechanism and a movement limiting mechanism. The stability enhancing mechanism includes two rollers, mounted on an axle, that are selectively positionable side-by-side in a normal mode or spaced apart in a stable mode. A combine arm, mounted on a pivot axle, has two fingers that pivot downward to cam the rollers inward along the axle from the stable to the normal mode. Alternatively, a separator arm, mounted on the pivot axle, pivots downward to slide the two rollers apart along the axle from the normal mode to the stable mode. The combine arm has a combine control lever and the separator arm has a separator control lever that extend rearward of the pivot axle. A control knob, rotatably mounted on the rear chassis of the skate, has control grooves that receive the combine control lever and separator control lever. Rotation of the knob controls the movement of the combine arm and separator arm, and therefore allows the user to select either the normal or stable mode.

The movement limiting mechanism includes a roller mounted on an axle, having teeth formed on the radially inner surface of the cylindrical outer portion. A pawl has a pawl arm extending into the inner cylindrical portion of the roller to selectively engage the teeth and a pawl tongue that extends into a pawl adjuster. The pawl adjuster has a retaining slot and is slidably positioned in a well in the front chassis of the skate to cam the pawl up into a nonengaging position corresponding to the free wheeling mode. The pawl adjuster can also be positioned to allow the pawl to ride on the teeth of the roller, corresponding to the forward only mode, or to restrain the pawl in the engaging position, corresponding to the full stop mode.

The in-line skate of the present invention allows the user to quickly and easily switch from the configuration of a conventional in-line skate—the normal mode—to an in-line skate having enhanced lateral stability—the stable mode. The change in modes requires no assembling or disassembling and is easy enough to permit a child to make the switch in modes. Similarly, the movement limiting mechanism is easily operatable to allow a child to switch between the free wheeling, forward only, and full stop modes.

DETAILED DESCRIPTION

Figure 1A:
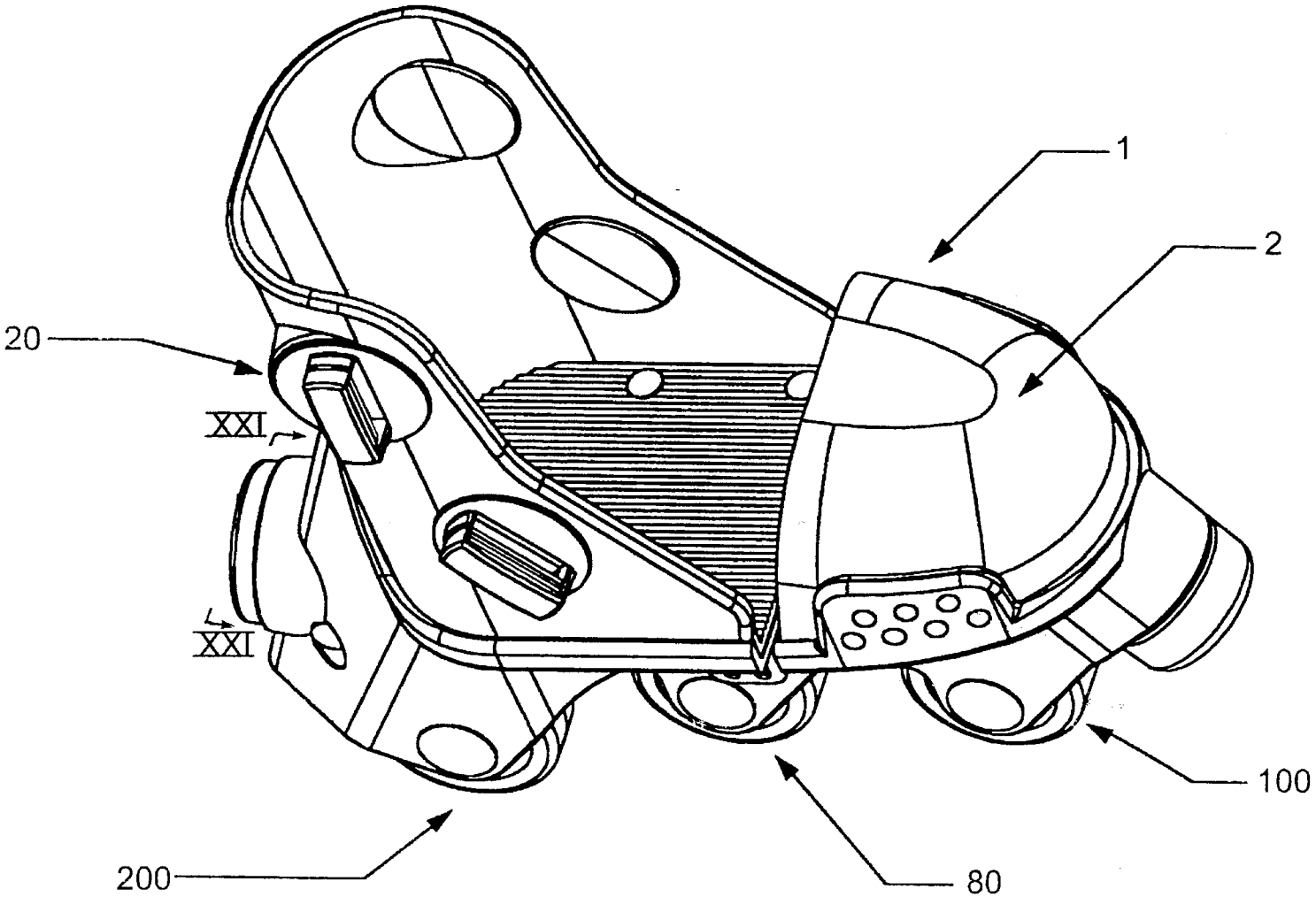
FIGS. 1A and B are top and bottom perspective views of an in-line roller skate incorporating the principles of the present invention.
Figure 1B:
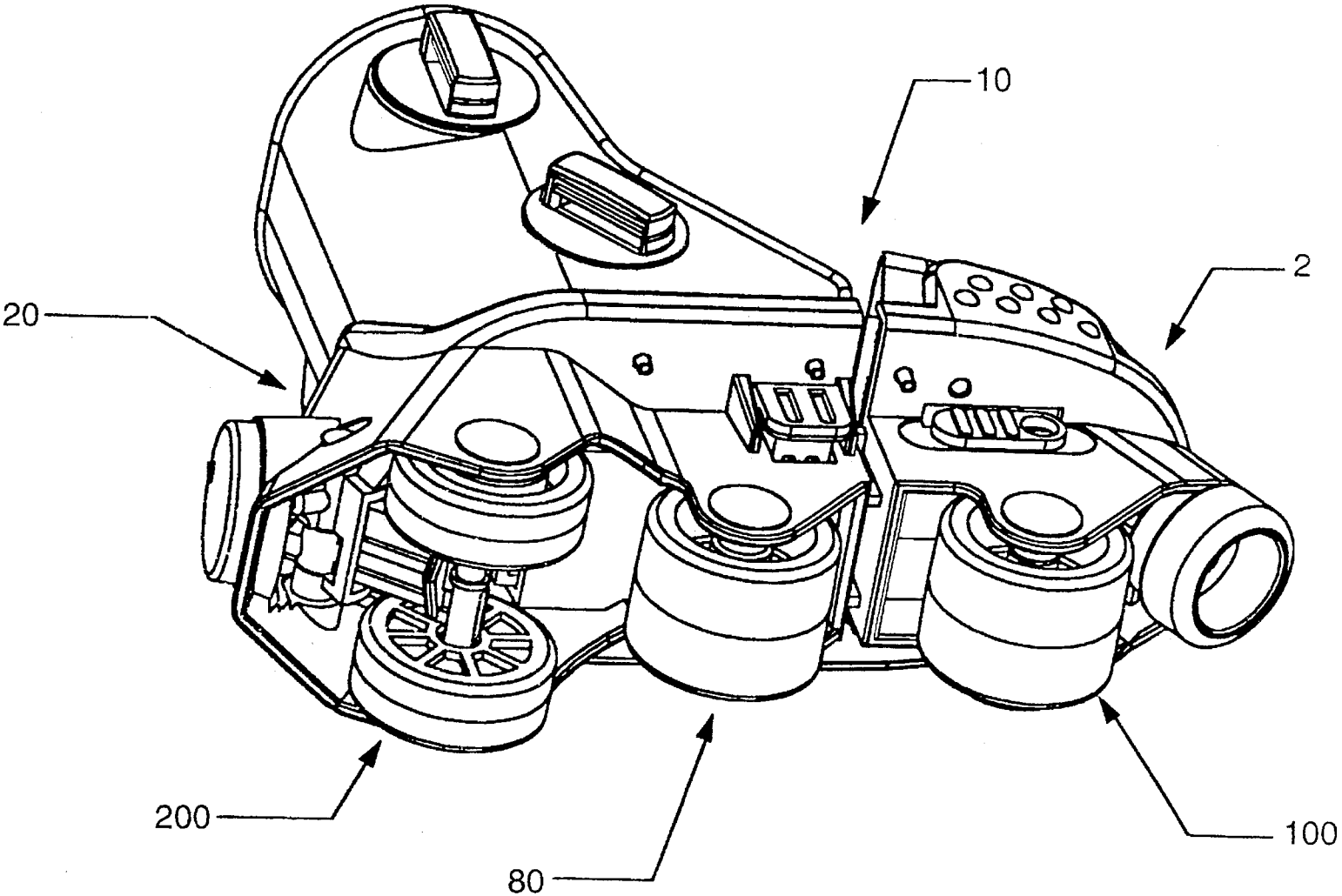

An in-line roller skate 1 is illustrated in FIGS. 1A and 1B. Skate 1 has a front assembly 2 and a rear assembly 20. In this embodiment, front roller assembly 100 incorporates a movement limiting mechanism and is mounted on front assembly 2 and rear roller assembly 200 incorporates a stability enhancing mechanism and is mounted on rear assembly 20.

Front assembly 2 and rear assembly 20 are coupled for selective, slidable relative movement to adjust the spacing between the two assemblies to accommodate feet of differing sizes. The adjustment mechanism is conventional.

Movement Limiting Mechanism

Figure 2A:
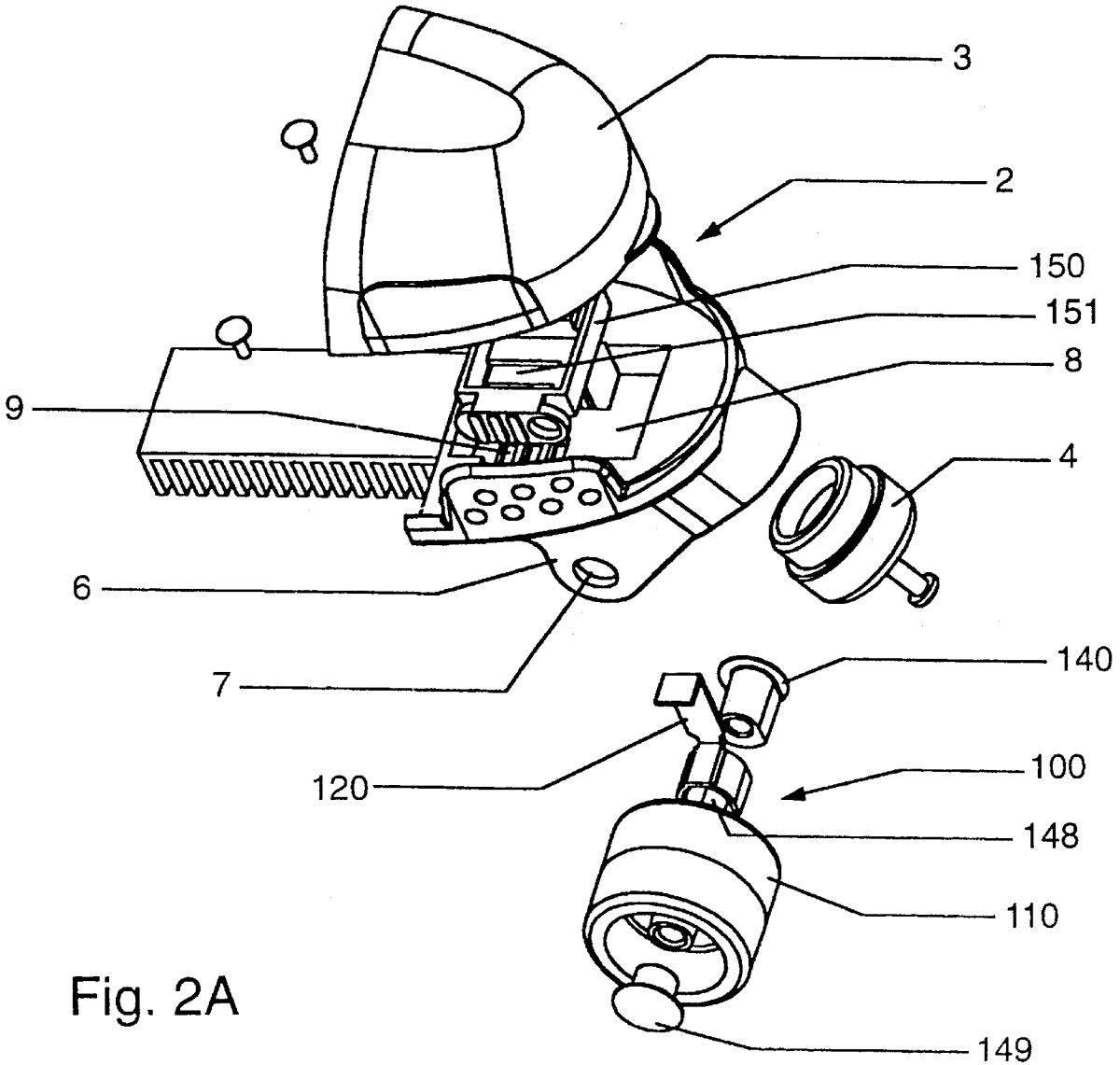
FIG. 2A and B are top and bottom exploded perspective views of the front assembly of the in-line skate of FIG. 1.
Figure 3:
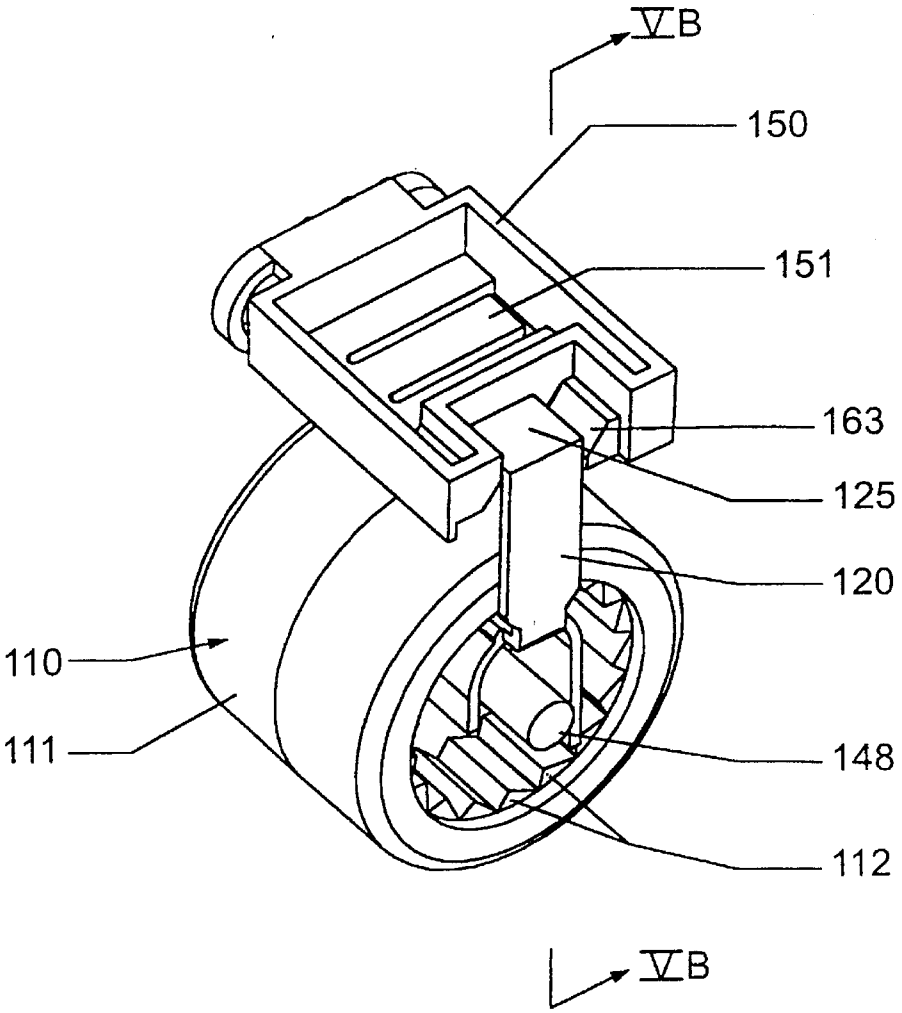
FIG. 3 is a perspective view of the front roller assembly of the skate in FIG. 1 with the cap retainer removed.

Referring to FIGS. 2A and B, front assembly 2 includes a toe 3, a toe stop 4, a front chassis 6, and a front roller assembly 100 (also shown in FIG. 3). Front roller assembly 100 has a roller 110 rotatably mounted on an axle 148 and held in place by a retaining cap 140 and an axle cap 149, and a vertically moveable pawl 120 controlled by a pawl adjuster 150.

Figure 10:
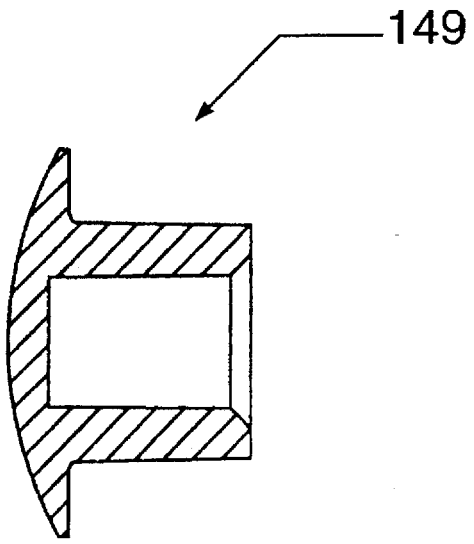
FIG. 10 is a cross-sectional side view of the axle cap of the front roller assembly of FIG. 2.

Referring also to FIGS. 4A–C and 5A–B, roller 110 is rotatably mounted on axle 148 which extends through axle bore 114. Roller 110 has teeth 112 formed on the radially inner right surface of cylindrical outer portion 111. Axle 148 of front roller assembly 100 is held in front chassis 6 by press fitting axle 148 into retaining cap 140 and axle cap 149 (shown in FIG. 10), which pass through corresponding left and right chassis openings 5, and 7.

Figure 8A:
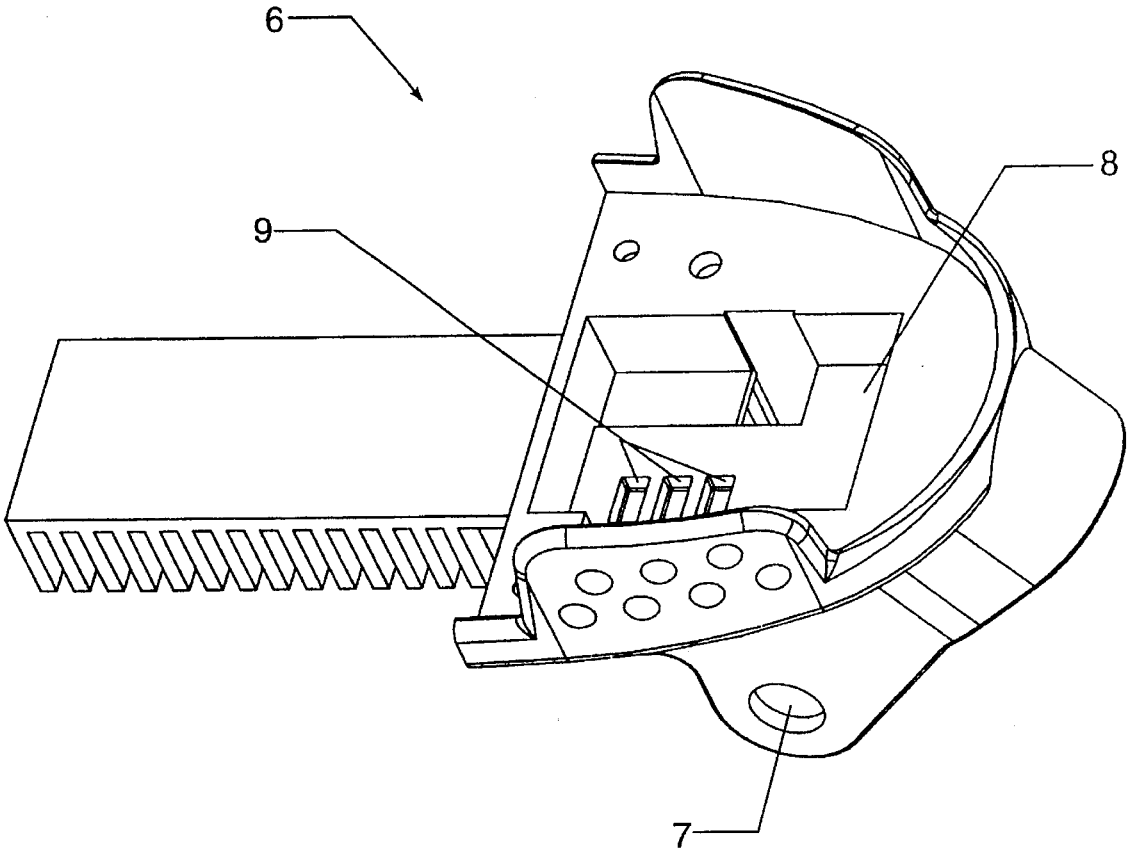
FIGS. 8A–D are perspective, top, bottom, and side views of the front chassis of the front assembly of FIG. 2.
Figure 8B:
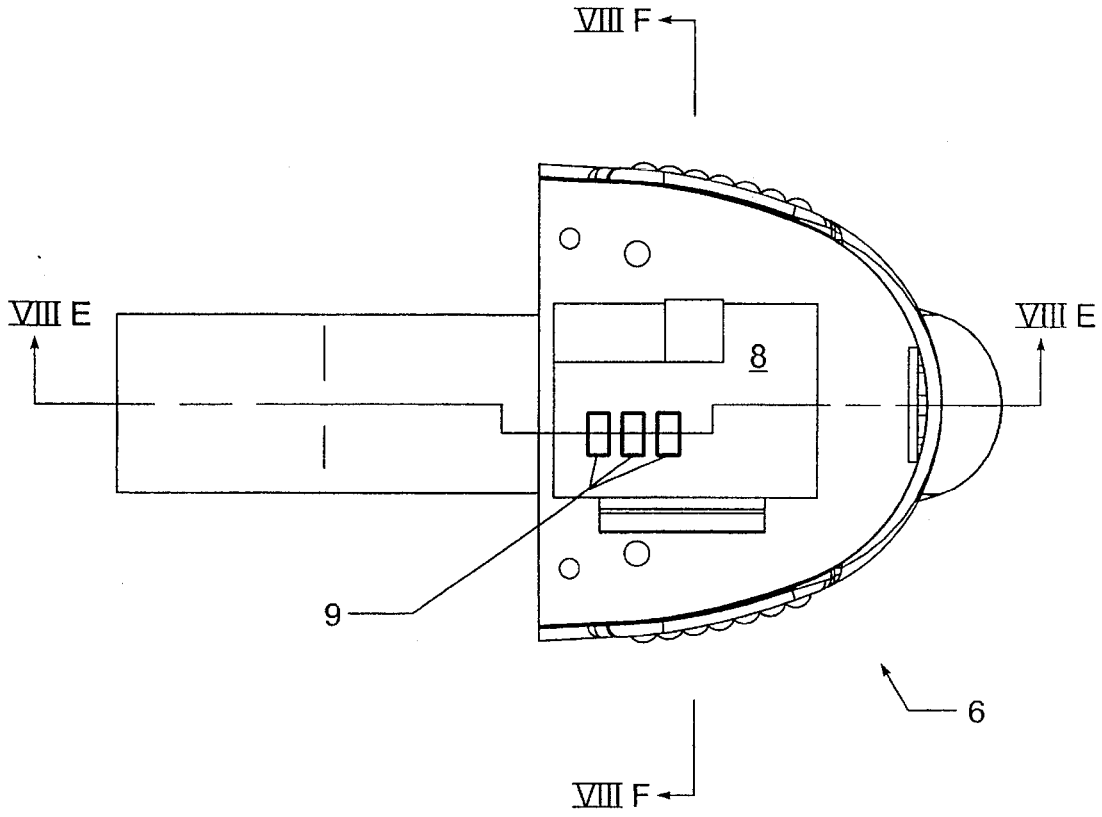
Figure 8C:
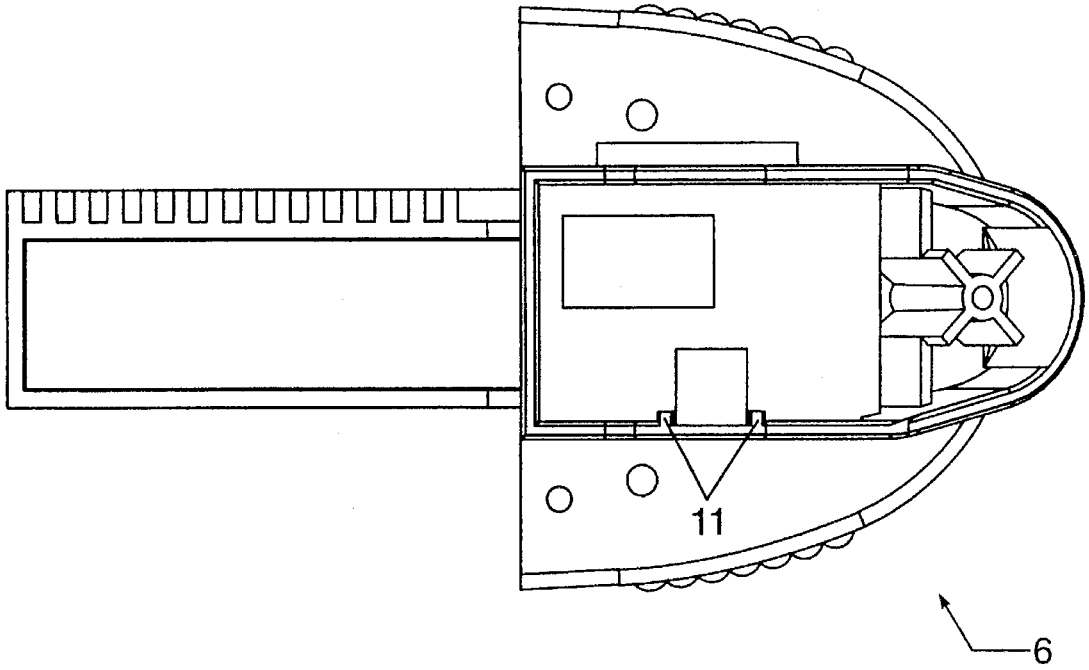
Figure 8D:
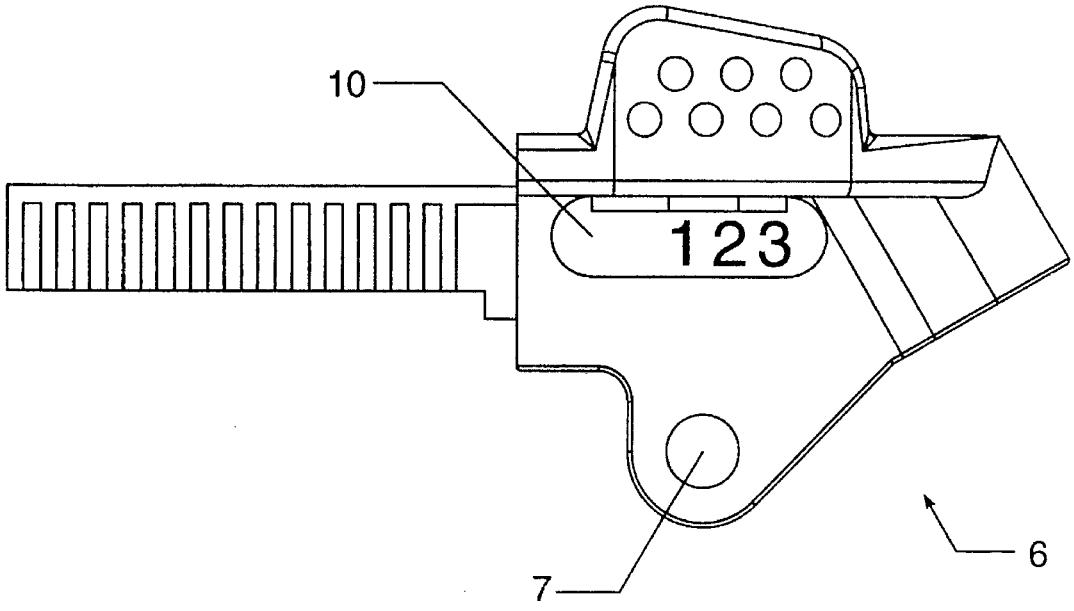
Figure 8E:
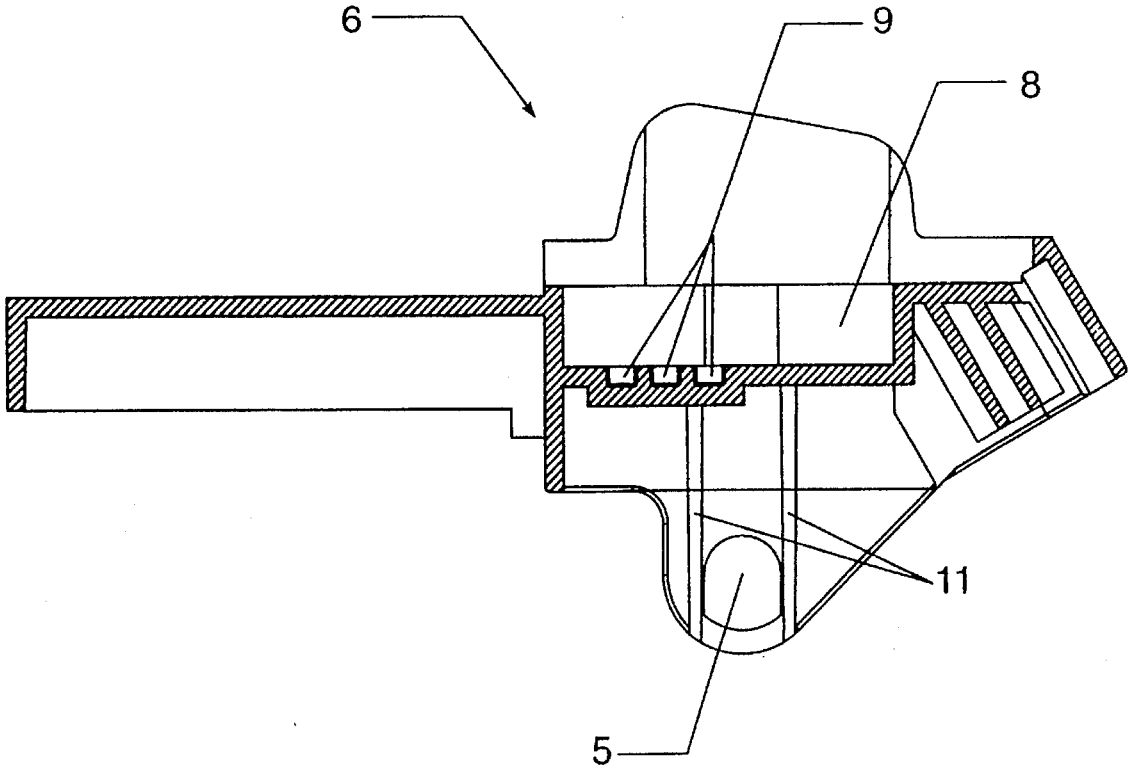
FIGS. 8E and 8F are cross-sectional side and end views of the front chassis taken along line VIIIE—VIIIE and VIIIF—VIIIF, respectively in FIG. 8B.
Figure 8F:
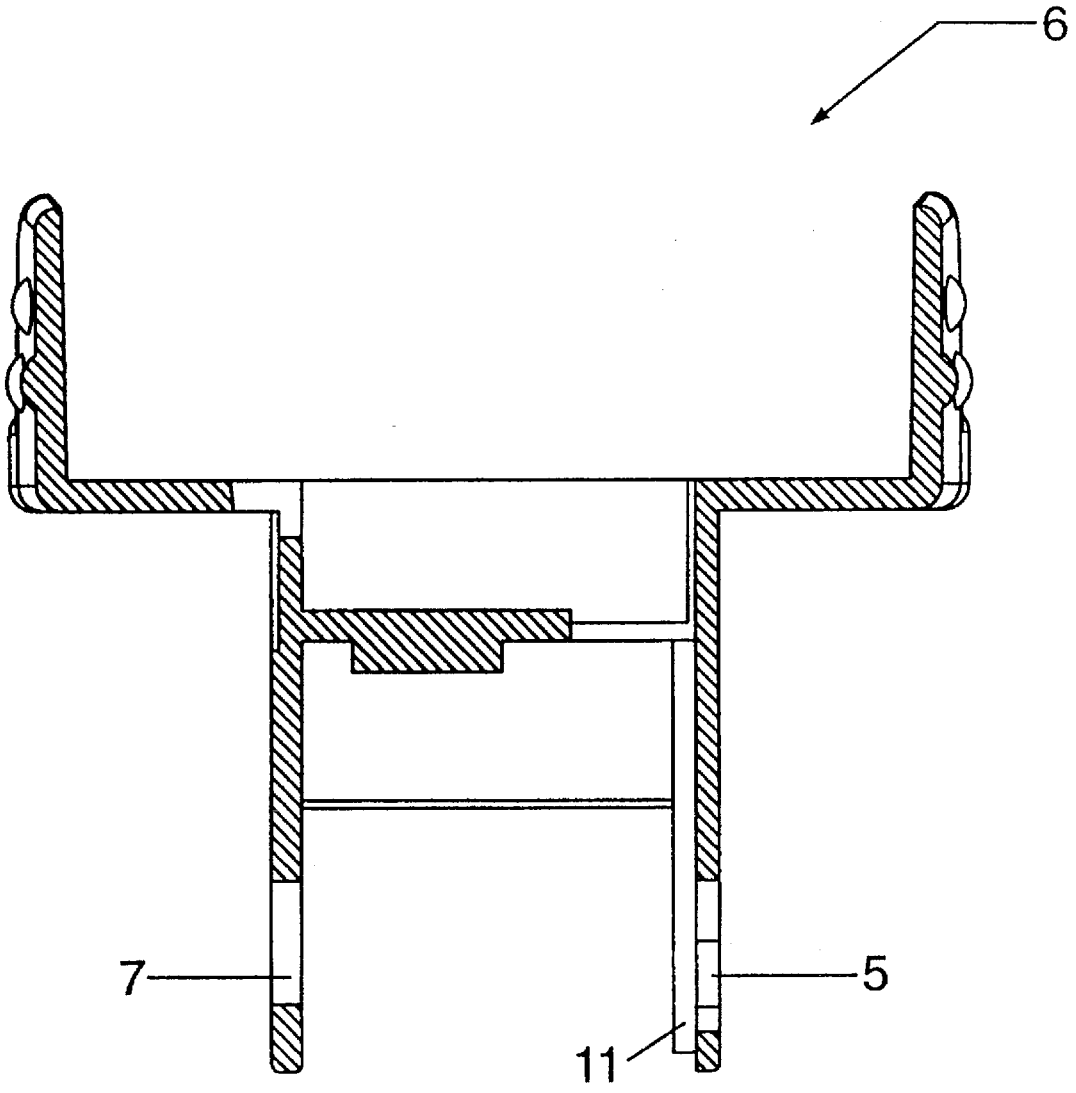

Pawl adjuster 150, shown FIGS. 2A–B, 3, 4A–C and 6A–F, controls the vertical position of pawl 120 and is slidably positioned in well 8 of front chassis 6 (shown in detail in FIGS. 8A–F) of skate 1 in any conventional manner to allow pawl adjuster 150 to slide forward and backward along a path that is parallel with the longitudinal center-line of the skate. Retaining slot 155, which is defined by a channel in pawl adjuster 150, the surface of well 8, and the under side of toe 3, includes a center portion 160, a pawl camming surface 163, an upper groove 165, and a lower groove 170. Pawl adjuster 150 has a flexible tab 151 with a downwardly extending finger 151*a* that selectively engages one of three slots 9 in the surface of well 8 in front chassis 6 to hold pawl adjuster 150 in a selected one of three positions. Pawl adjuster 150 also has an actuator 152 which includes a hole 153. Actuator 152 is separated from the body of pawl adjuster 150 by a slot 154 that engages well wall 10 of well 8 of chassis 6 to guide and retain pawl adjuster 150. Visual indication of pawl adjuster 150 position is given by viewing a number (1, 2, or 3, which are on front chassis 6 shown in FIGS. 8A and D) though hole 153. In this embodiment, a "1" visible through hole 153 of actuator 152 indicates to the user that the skate is in the full stop mode, a "2" indicates the forward only mode, and a "3" indicates the free wheeling mode. Ribs on the bottom of toe 3 engage the top of pawl adjuster 150 and stiffen toe 3.

Figure 7A:
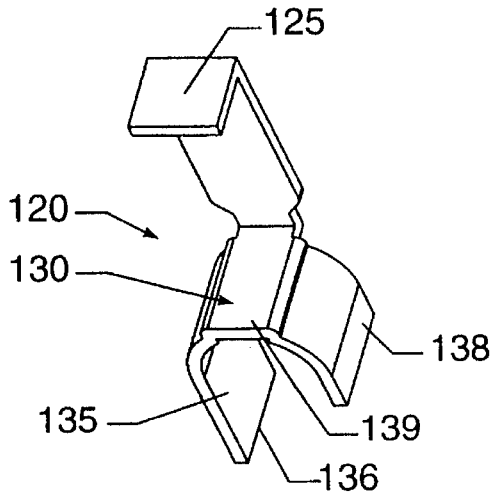
FIGS. 7A–C are perspective, front, and side views of the pawl in FIG. 3.
Figure 7B:
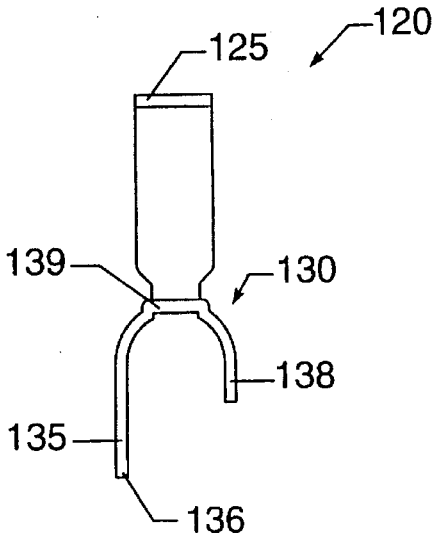
Figure 7C:
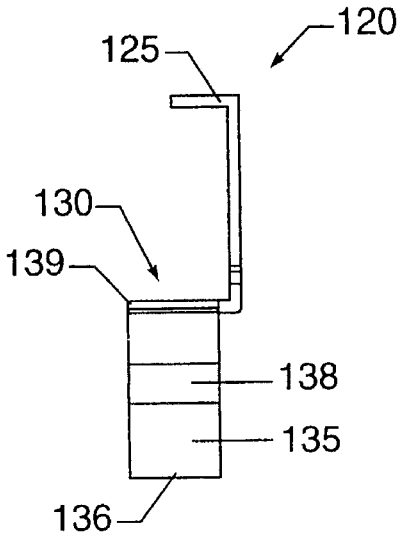

Pawl 120 (shown in FIGS. 7A–C) has a pawl arm 125, which extends into retaining slot 155, and a pawl tongue 130, which extends into right toothed side of roller 110. Pawl tongue 130 has a teeth engaging side 135 with teeth engaging end 136, a guide side 138, and a top side 139 formed into a semi-circular shape. Pawl 120 is mounted for vertical movement, sliding between a first upper nonengaging position in which engaging end 136 of pawl 120 does not contact teeth 112 of roller 110 and a second lower engaging position in which the engaging end 136 of pawl 120 rests on teeth 112 of roller 110.

Figure 2B:
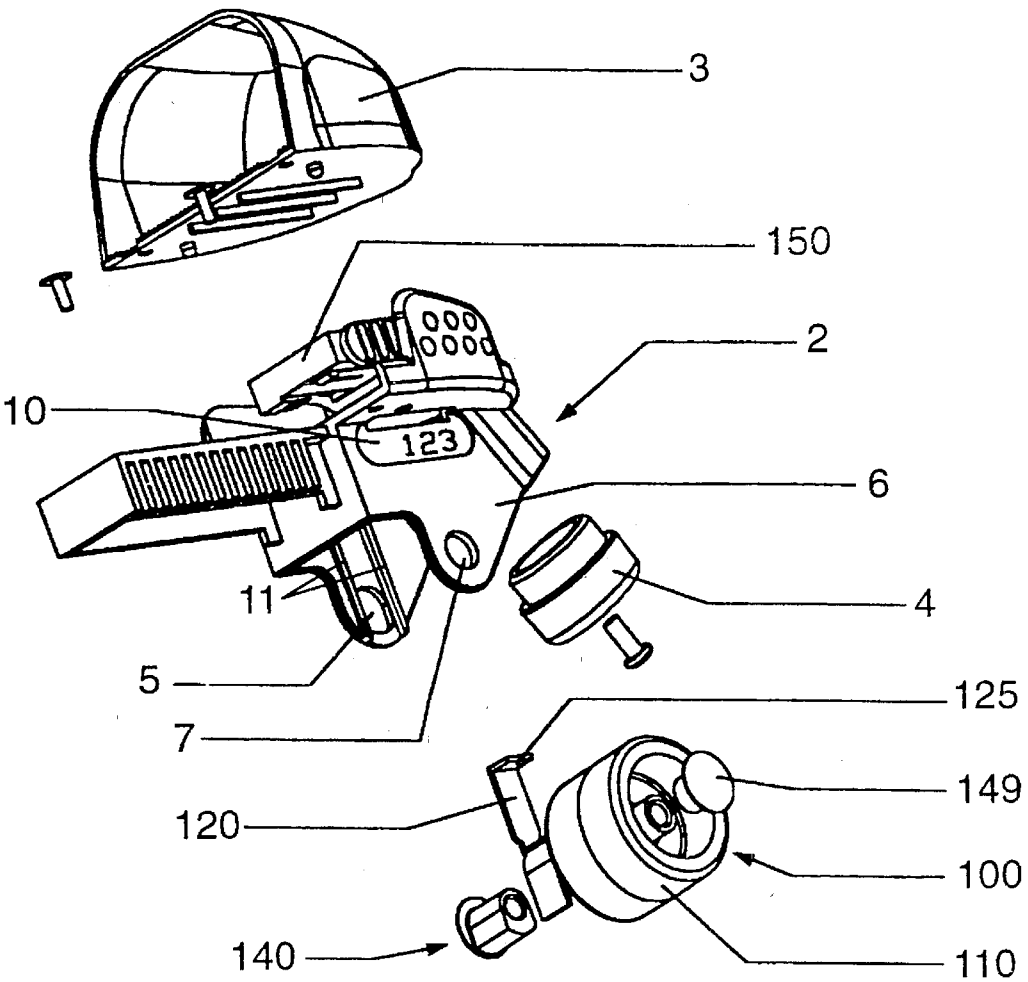
Figure 9A:
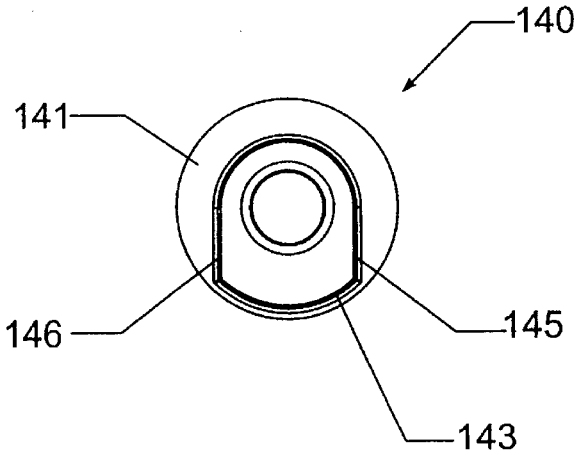
FIGS. 9A and B are end and cross-sectional side views of the retainer cap of the front assembly of FIG. 2.
Figure 9B:
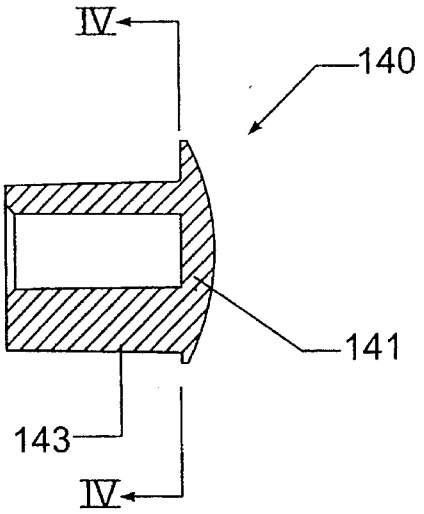

Referring to FIGS. 2A-B retaining cap 140 is fitted onto front roller axle 148 to retain roller 110 on axle 148. Retainer cap 140, shown in FIGS. 9A–B, includes an end portion 141, and a body portion 143 that has a top portion 142 (which is formed into a semi-circular shape), a bottom portion 144, and substantially flat side portions 145 and 146. Body portion 143 of retaining cap 140 is shaped so that it mates with pawl tongue 130 to keep pawl 120 in the same vertical path (and thus prevents pawl 120 from moving laterally) with respect to roller 110 and axle 148. Vertical ribs 11 on the inside of front chassis 6 further guide and support pawl 120.

Figure 4A:
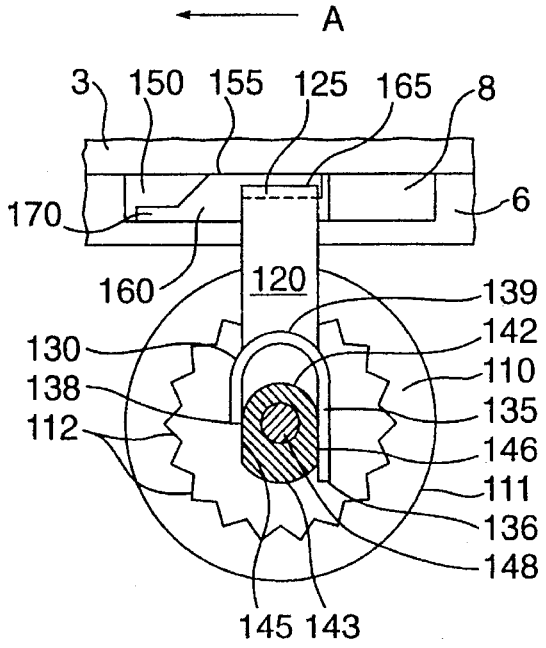
FIGS. 4A–C are side views of the front roller assembly of FIG. 1 with the end portion of the retaining cap removed along line IV—IV of FIG. 9B with the front roller assembly in the free wheeling, forward only, and full stop configurations, respectively.

The movement limiting mechanism of front roller assembly 100 is shown in the free wheeling mode in FIG. 4A. Pawl adjuster 150 is positioned in its most forward position (the direction of arrow A) in well 8 of front chassis 6. Consequently, pawl arm 125 has slid up pawl camming surface 163 and into upper groove 165 so that pawl 120 is held in this nonengaging position in which teeth engaging end 136 of pawl 120 is out of engagement with teeth 112. In this configuration, roller 110 is free to rotate about axle 148 in either direction since it is unimpeded by teeth engaging end 136 of pawl 120.

Figure 4B:
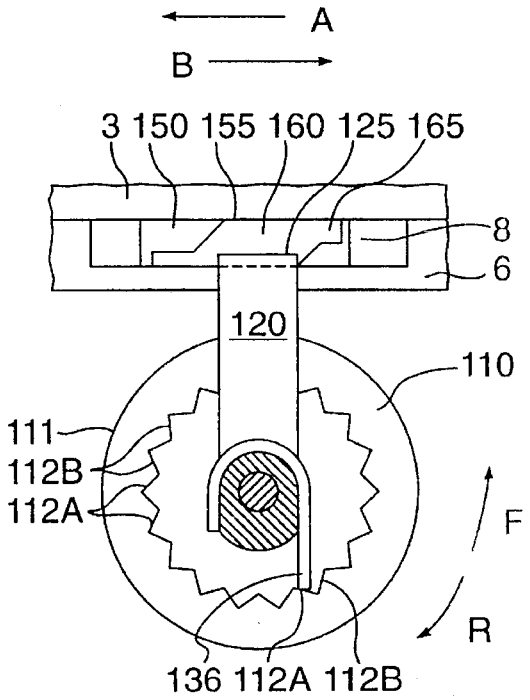

FIG. 4B shows the mechanism in the forward only configuration in which pawl adjuster 150 has been slid in the direction of arrow B (with respect to its position in FIG. 4A) and is positioned in the center of well 8. Pawl arm 125 thus extends into center portion 160 of retaining slot 155. Pawl 120, urged downward by gravity, but not constrained in this vertical position by pawl adjuster 150, is disposed in its lower engaging position. Teeth engaging end 136 of pawl 120 thus rests on teeth 112. Each tooth 112 has a first side 112A and a second side 112B. Teeth 112 are not symmetric about their apex, but have a more acute angle between the center-line of the tooth and second side 112B than between the center-line of the tooth and first side 112A.

When the skate is urged in the rearward direction (indicated by arrow B), roller 110 will be urged to rotate in the direction of arrow R. Consequently, the second side 112B of the adjacent tooth 112 will strike the outer side of teeth engaging end 136. The force applied to end 136 by second side 112B of tooth 112 is a lateral force, transverse to the longitudinal center-line of pawl 120. Since axle 148, retaining cap 140, and ribs 11 of front chassis 6, prevent pawl 120 from moving laterally, end 136 prevents second side 112B from rotating past end 136 and therefore prevents roller 110 from rotating in the direction of arrow R.

If the skate is moved in the forward direction (indicated by arrow A), roller 110 will be urged to rotate in the direction of arrow F. Consequently, first side 112A of tooth 112 will strike the bottom side of teeth engaging end 136. The force applied to end 136 by first side 112A of tooth 112 is substantially an upward longitudinal force parallel with the center-line of pawl 120. Since pawl 120 is not restrained in the engaging position, pawl arm 120 will slide upward, guided by the sides of retaining cap 140 and ribs 11, and pawl arm 125 will move toward the upper portion of center portion 160 in retaining slot 155. Pawl 120 will ride on teeth 112 being cammed upward by first side 112A of tooth 112 until that tooth has rotated out of engagement with end 136 at which time end 136 will drop down (due to gravity) onto the first side 112A of the next tooth 112 to the position shown in FIG. 4B. This cycle of riding up on first side 112A of a tooth 112 and dropping down onto the next tooth will repeat continuously as roller 110 rotates in the forward direction. Since the direction of rotation of this roller dictates the direction of movement of the skate (as discussed above), this configuration of the front roller assembly allows the skate to roll forward, but not rearward.

Figure 4C:
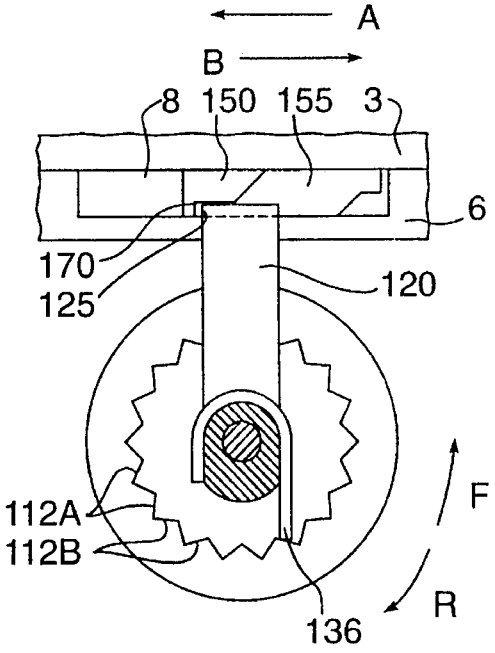
Figure 5A:
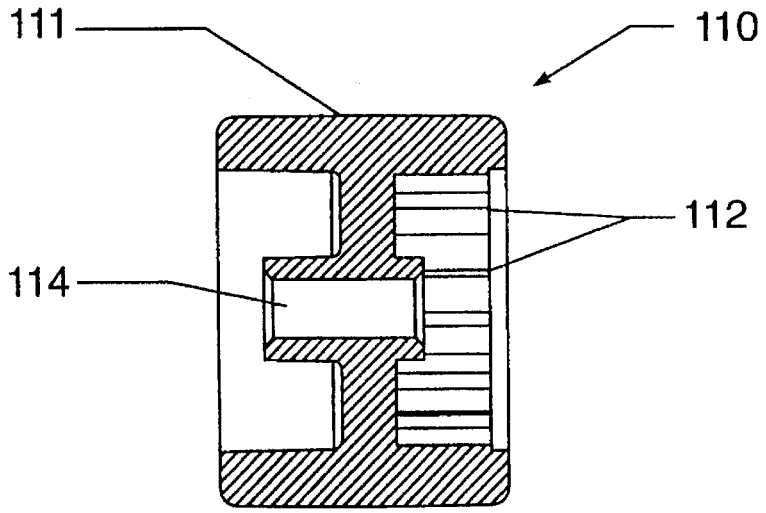
FIG. 5A is a cross-sectional view of the front roller of FIG. 3.
Figure 5B:
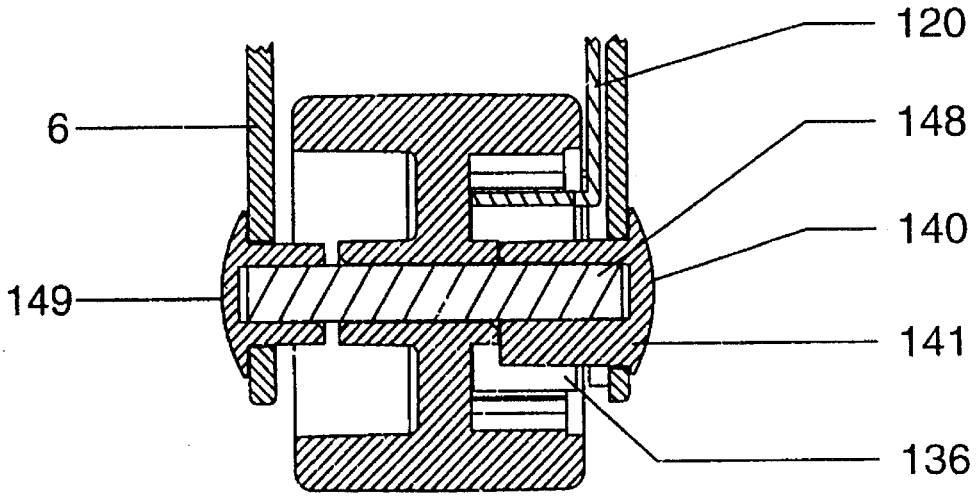
FIG. 5B is a partial cross-sectional view of the front roller assembly of FIG. 3 taken along line VB—VB.
Figure 6D:
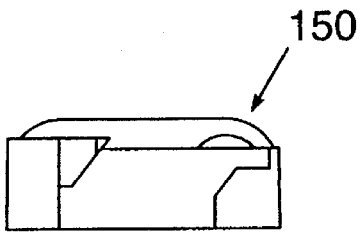
FIG. 6A–E are perspective, top, side, end, and bottom views of the pawl adjuster of FIG. 3
Figure 6C:
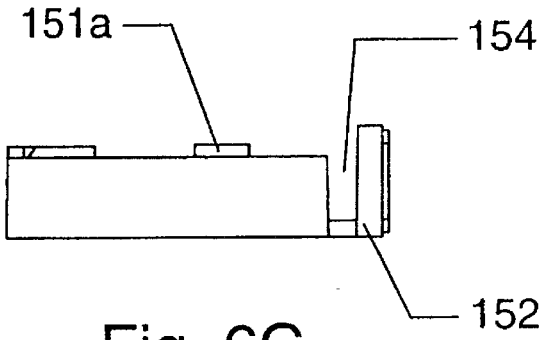
Figure 6B:
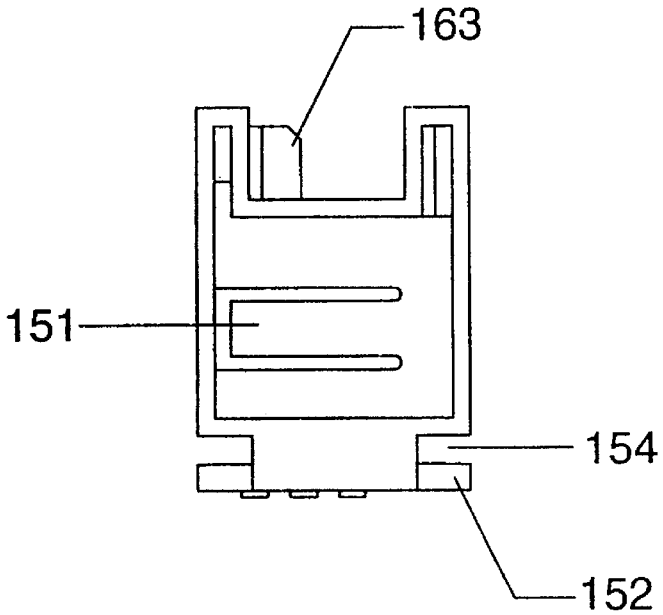
Figure 6F:
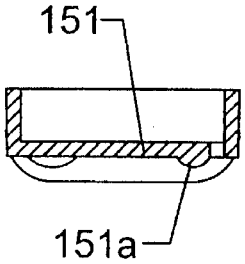
FIG. 6F is a cross-sectional view of the pawl adjuster of FIG. 3 taken along line VI—VI in FIG. 6E.
Figure 6A:
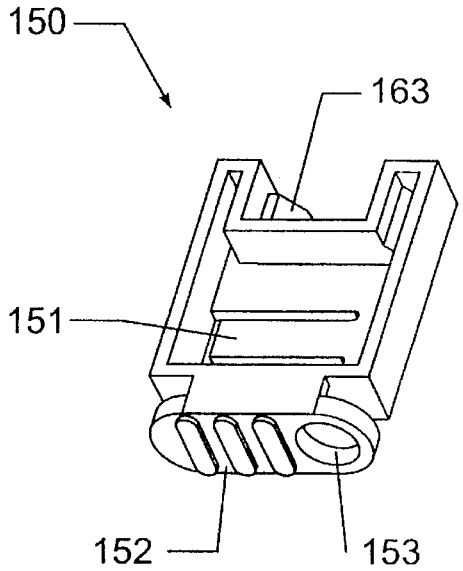
Figure 6E:
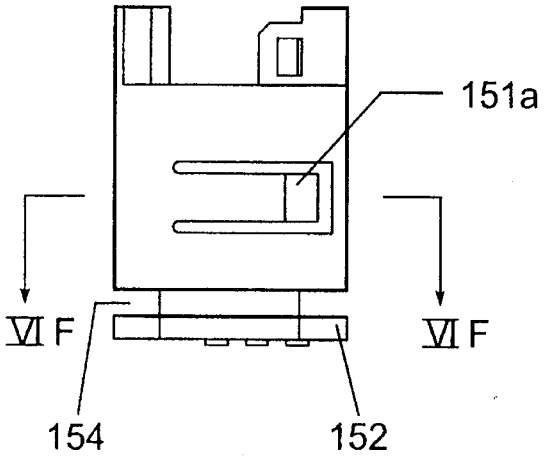

FIG. 4C shows the mechanism in the full stop mode in which pawl adjuster 150 has been slid to its most rearward position in well 8 of front chassis 6 (indicated by arrow B). Pawl arm 125 has slid into lower groove 170 of retaining slot 155. With pawl 120 in this engaging position, roller 110 cannot rotate in the direction of arrow R for the same reasons as those discussed above.

Furthermore, since lower groove 170 of pawl adjuster 150 retains pawl arm 125 in the engaging position (prevents pawl 120 from moving upward), pawl 120 cannot be cammed upward by first side 112A of moth 112 as previously discussed. Therefore, in this configuration roller 110 cannot be rotated in the direction of arrow F either. Consequently, with pawl adjuster 150 in the rearward position, roller 110 cannot rotate in any direction and therefore skate 10 cannot roll forward or rearward.

The components of this embodiment (except for the pawl) are formed from plastic although any sufficiently rigid material would suffice. Due to the strength requirements of the pawl, the pawl of this embodiment is formed from metal.

The movement limiting mechanism of the present embodiment is laterally compact since the pawl, the pawl adjuster, and other components are positioned almost entirely within a lateral envelope defined by the edges of the roller, and entirely within the lateral extent of the outer ends of the axle cap. This is accomplished by disposing pawl adjuster 150 (and pawl arm 125) radially outwardly from the outer surface of roller 110 and substantially laterally within the lateral envelope defined by the edges of roller 110, and by further configuring the pawl so that pawl tongue is within the lateral envelope and the body of the pawl (connecting the pawl tongue to the pawl arm) is laterally compact and as close to the outside edge of the wheel as possible. Although movement limiting mechanisms in a conventional four wheel skate can similarly be considered to be within this lateral envelope, they are disposed above the axle between the two rollers. However, in an in-line skate, which has a single roller, the lateral envelope is only slightly wider than the roller itself, and known movement limiting mechanisms cannot be accommodated within this lateral envelope. Therefore, the laterally compact aspect of the disclosed design is particularly well suited for use in an in-line skate. If the mechanism were instead disposed to one side of the lateral envelope, its components would be exposed to damage and thus would be less reliable.

In the preferred embodiment, the movement limiting mechanism is employed on only the front roller assembly of each skate. The friction between one roller and the travel surface should be sufficient to provide the desired frictional forces. However, the mechanism could be adapted to any of the rollers or to more than one roller if greater frictional force is desired.

In the present embodiment, the pawl moves vertically and is gravity biased down so that it engages teeth on the inner surface of the roller and the pawl adjuster slides along an axis perpendicular to the axis of pawl movement and has a camming surface to move the pawl. However, the present invention could also be employed in other embodiments such as those having a horizontally moving pawl that is spring biased, a pawl adjuster that moves along a path that is parallel with the direction of movement of the pawl, a roller having teeth on the outside of the hub of the wheel, or a pawl and pawl adjuster that move in a pivotal fashion.

Stability Enhancing Mechanism

Figure 11A:
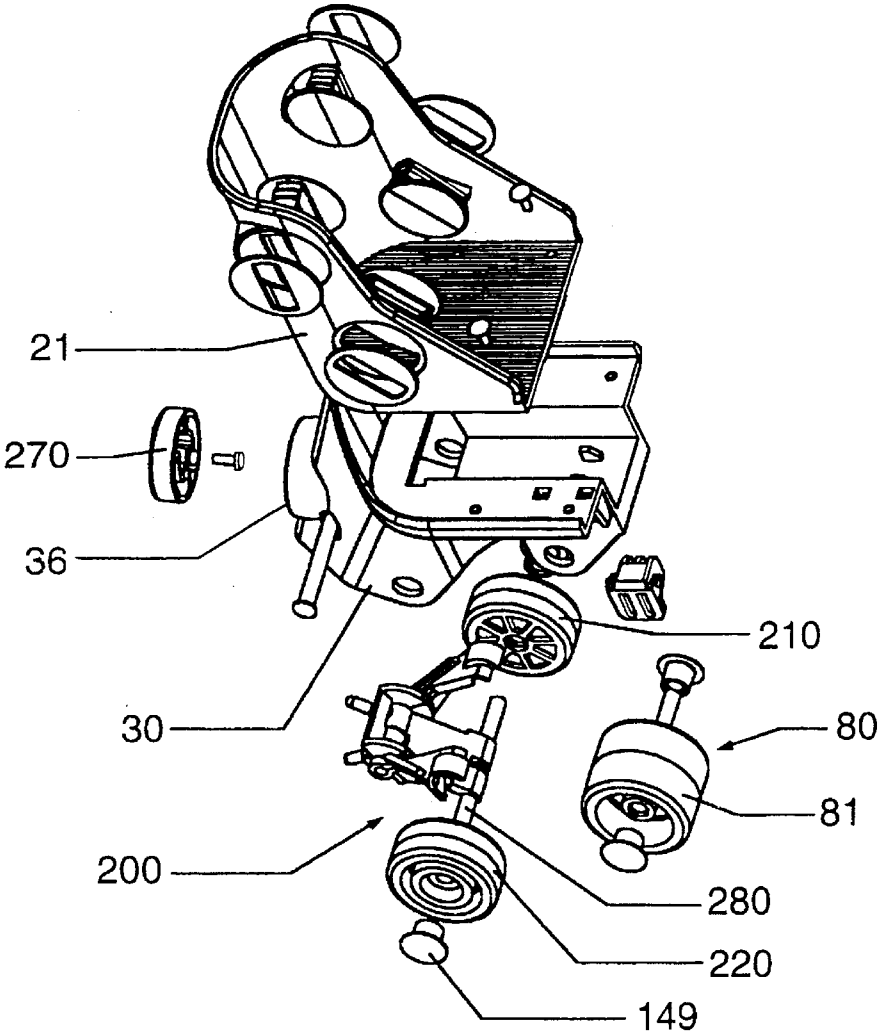
FIGS. 11A–B are top and bottom exploded perspective views of the rear assembly of the skate of FIG. 1.

As shown in FIGS. 11A and B, rear assembly 20 includes a boot 21, a rear chassis 30, a rear roller assembly 200 and a center roller assembly 80, both of which are mounted to the bottom of rear chassis 30. Rear roller assembly 200, shown in FIGS. 12A and B, includes an axle assembly 202 and a control assembly 204. Axle assembly 202 includes left roller 210 and right roller 220, which are mounted on roller axle 280 for rotation about axle 280 and for sliding along the axle. The rollers are separated by an axle rib 281 which protrudes at the midpoint of axle 280 to prevent the rollers from crossing the center-line of the skate on axle 280. Axle 280 extends through axle bores 215, 225 and is coupled to the left and right side walls 31, 32 of rear chassis 30 (which is shown in detail in FIGS. 16A–G) via axle caps 149, which are press fit onto axle 280 and disposed in holes 33, 34 of side walls 31, 32.

Figure 11B:
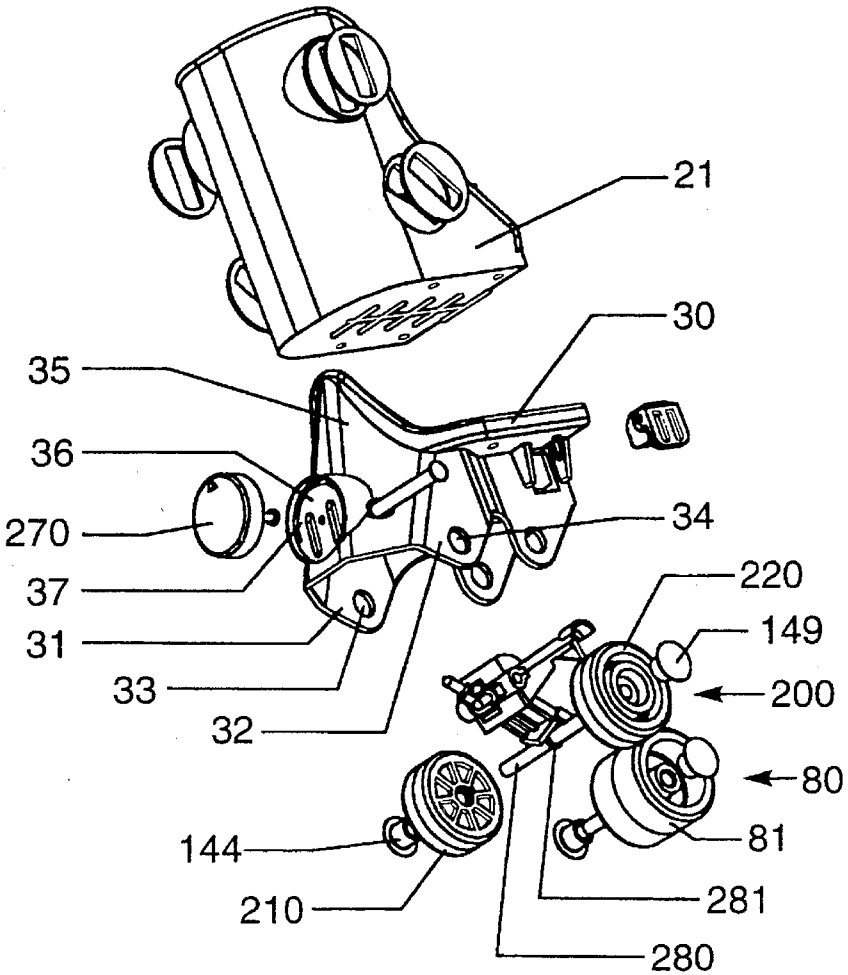

Control assembly 204 includes a separator arm 230 and a combine arm 250 which are nested together and co-pivoted on pivot axle 288 and are actuated by control knob 270. Pivot axle 288 is also coupled to the left and right side walls 31, 32 of rear chassis 30. Control knob 270, shown in FIGS. 11A–B, is rotatably mounted to the rear wall 35 of rear chassis 30 in a control knob well 36.

Figure 12A:
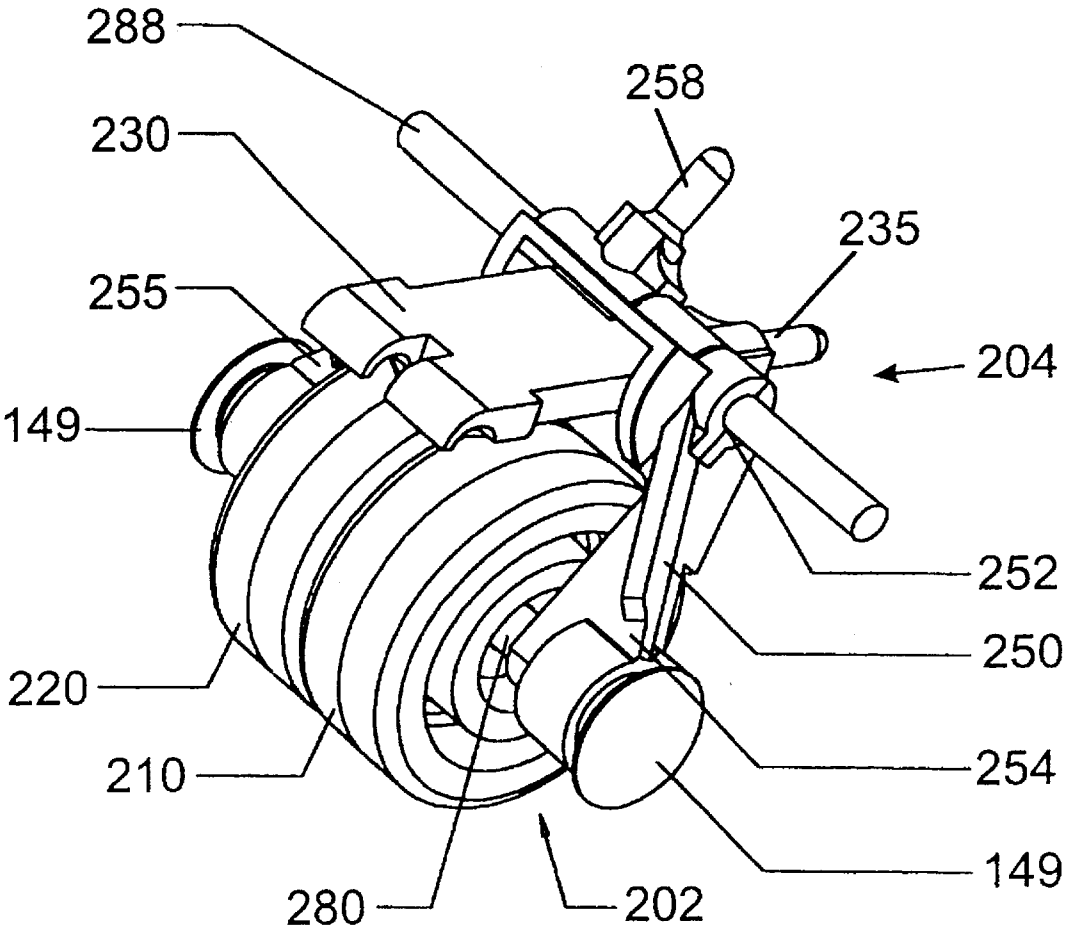
FIGS. 12A–B are partial perspective views of the rear roller assembly of the skate of FIG. 1 in the normal mode and stable mode.

As shown in FIGS. 13A–F, combine arm 250 has a body portion 251 with a pivot axle bore 252 extending laterally therethrough. A combine control lever 258 extends rearwardly from the body portion, while symmetrical left and right combine fingers 254, 255 extend forwardly from the body portion. Combine fingers 254, 255 include axle recesses 256, 257, axle cap recesses 264, 265, inwardly directed combine cam surfaces 260, 261, and inside edges 262,263 respectively. A generally rectangular separator lever opening 253 is formed in the body portion 251 to permit passage of the separator control lever 235 therethrough. As shown in FIGS. 12A and B, combine arm 250 is pivotally mounted on pivot axle 288 which extends through pivot axle bore 252.

As shown in FIGS. 14A–G, separator arm 230 has a body portion 231 with a pivot axle bore 237 extending laterally therethrough. A separator control lever 235 extends rearward from body portion 25 1 while engaging end 245 extends forward of body portion 251. Engaging end 245 includes axle recesses 238, 239, outside surfaces 242, 243, rib gap 232, and outwardly directed separator cam surfaces 240, 241. Separator arm 230 is pivotally mounted on pivot axle 288 at separator lever opening 253 of combine arm 250 as shown in FIG. 12A and B.

Control knob 270, shown in FIGS. 15A–E, includes a separator control groove 276 for receiving separator control lever 235 of separator arm 230 and a combine control groove 271 for receiving combine control lever 258 of combine arm 250. Each groove 271,276 has an upper end 272, 277, a lower end 273, 278, and a corner portion 274, 279. Knob 270 is rotatably mounted to rear chassis 30 (which is shown in detail in FIGS. 16A–G) by any appropriate conventional means such as a screw (shown in FIGS. 11A–B), which extends into screw bore 299 of knob 270. As shown in FIG. 11B, control knob 270 is received in control knob well 36 in the rear wall 35 of rear chassis 30, which includes a groove 37 in which tab 298 of control knob 270 rides. Control knob well 36, which is also shown in FIGS. 16A–G, is bounded by peripheral wall 38 surrounding a bottom surface 39. Control knob well 36 also includes generally vertical control lever slots 40, 41 formed in bottom surface 39, though which combine and separator control levers 258, 235 protrude into combine and separator control grooves 271,276, respectively.

As shown in FIG. 17, rollers 210, 220 each have an inside corner 211, 221, an outside corner 212, 222, an inside edge 214, 224, an outside hub 216, 226, a support surface 213, 223 and an axle bore 215, 225. The inner side of rollers 210, 220 has spoke-like ribs 217, 227 while the outer side of rollers 210, 220 has an annular wall 218, 228 which is sized and shaped to receive axle caps 149. The aggregate thickness of the two rollers 210, 220 is approximately equal to that of front and center rollers 110, 81.

Figure 12B:
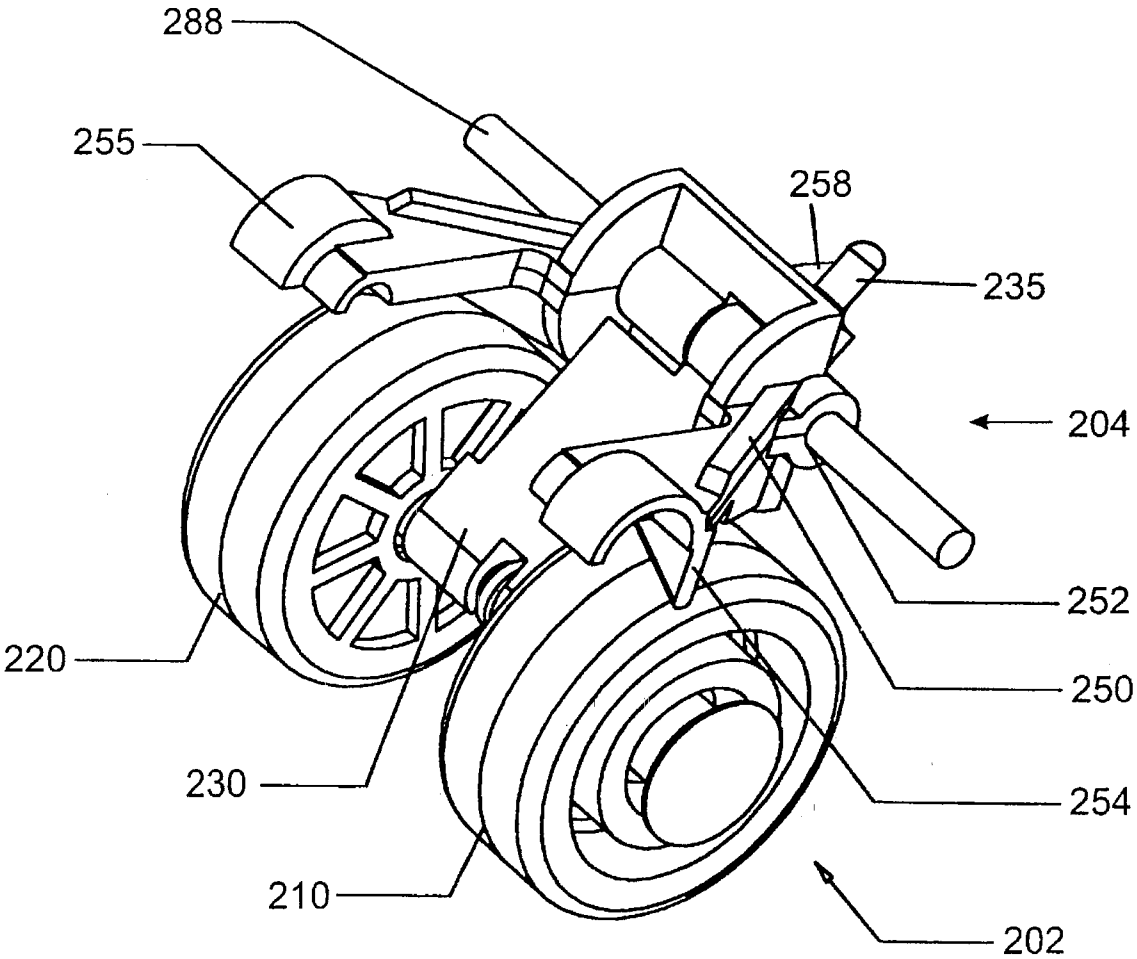
Figure 13A:
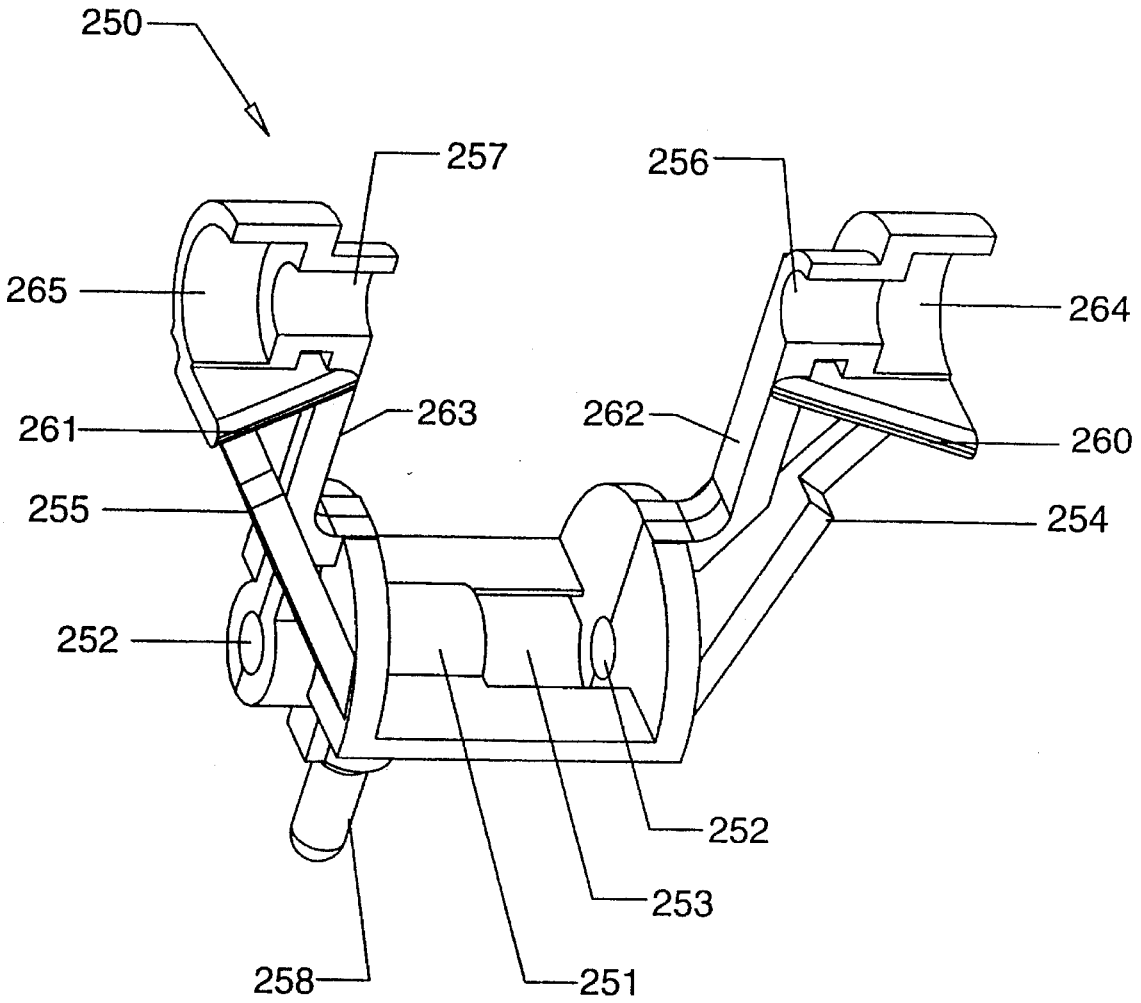
FIGS. 13A–F are perspective, top, bottom, front, rear, and side views of the combine arm of rear roller assembly of FIGS. 11A and B.
Figure 13B:
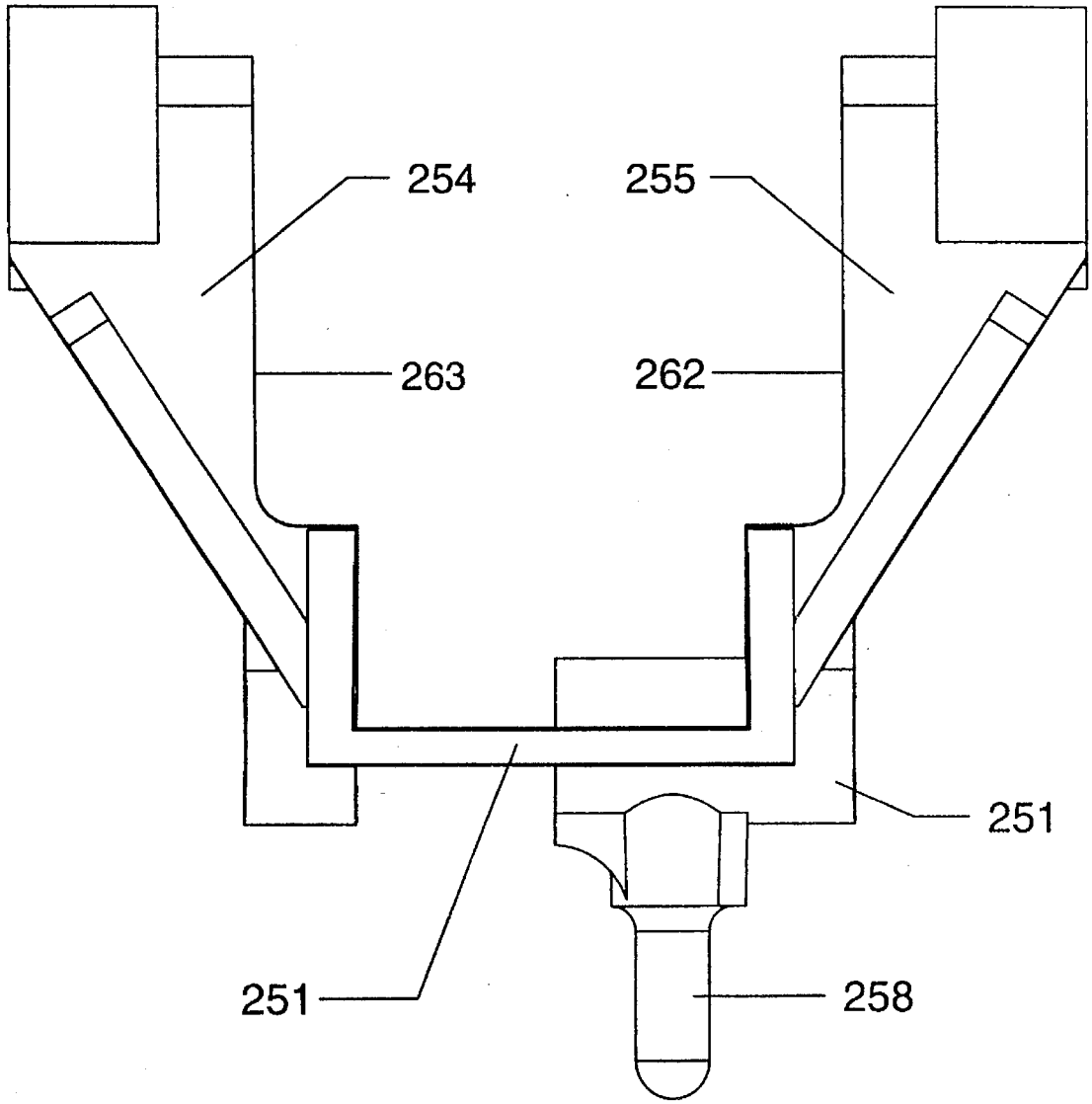
Figure 13C:
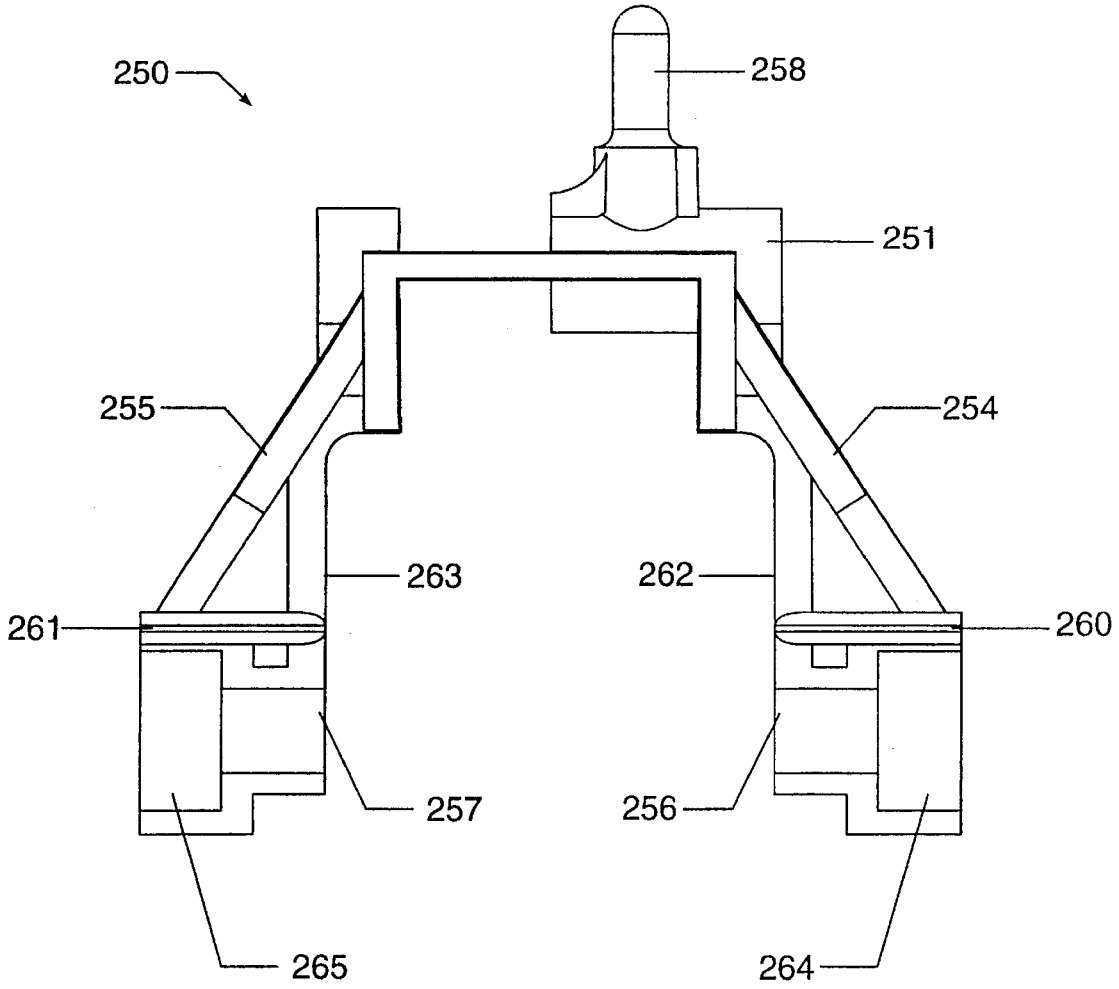
Figure 13D:
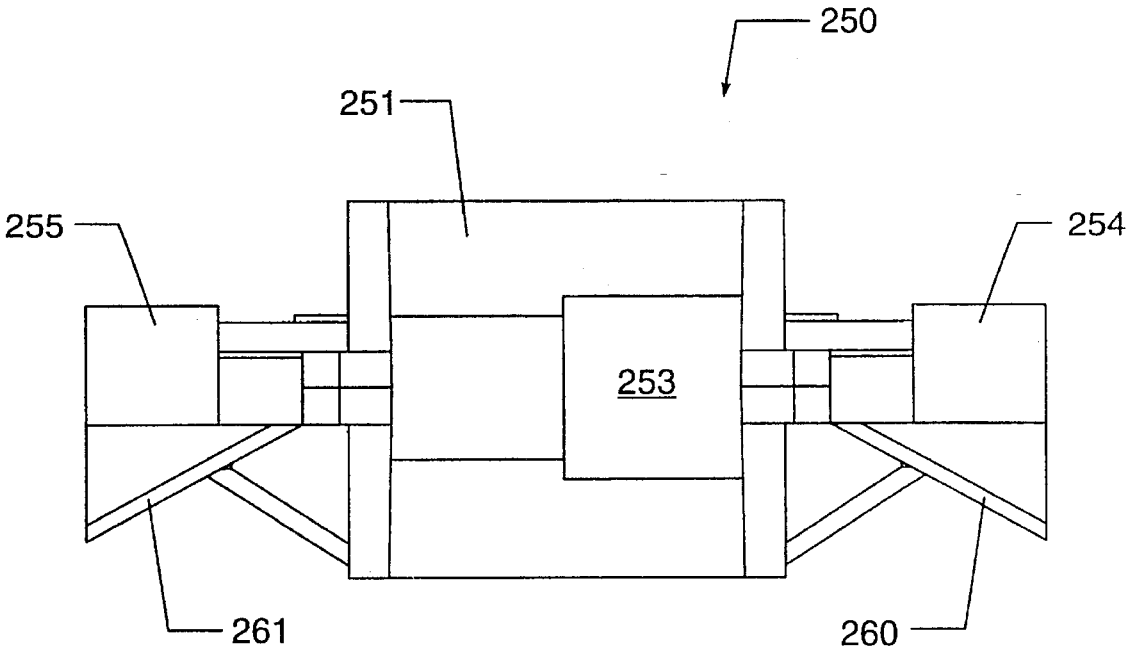
Figure 13E:
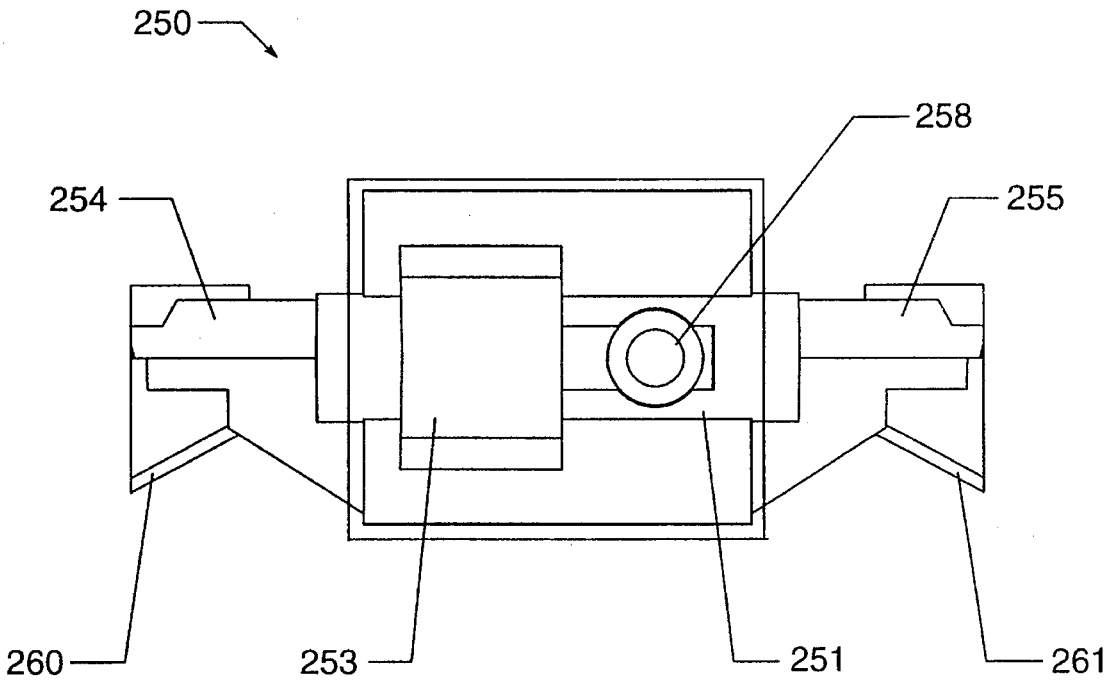
Figure 13F:
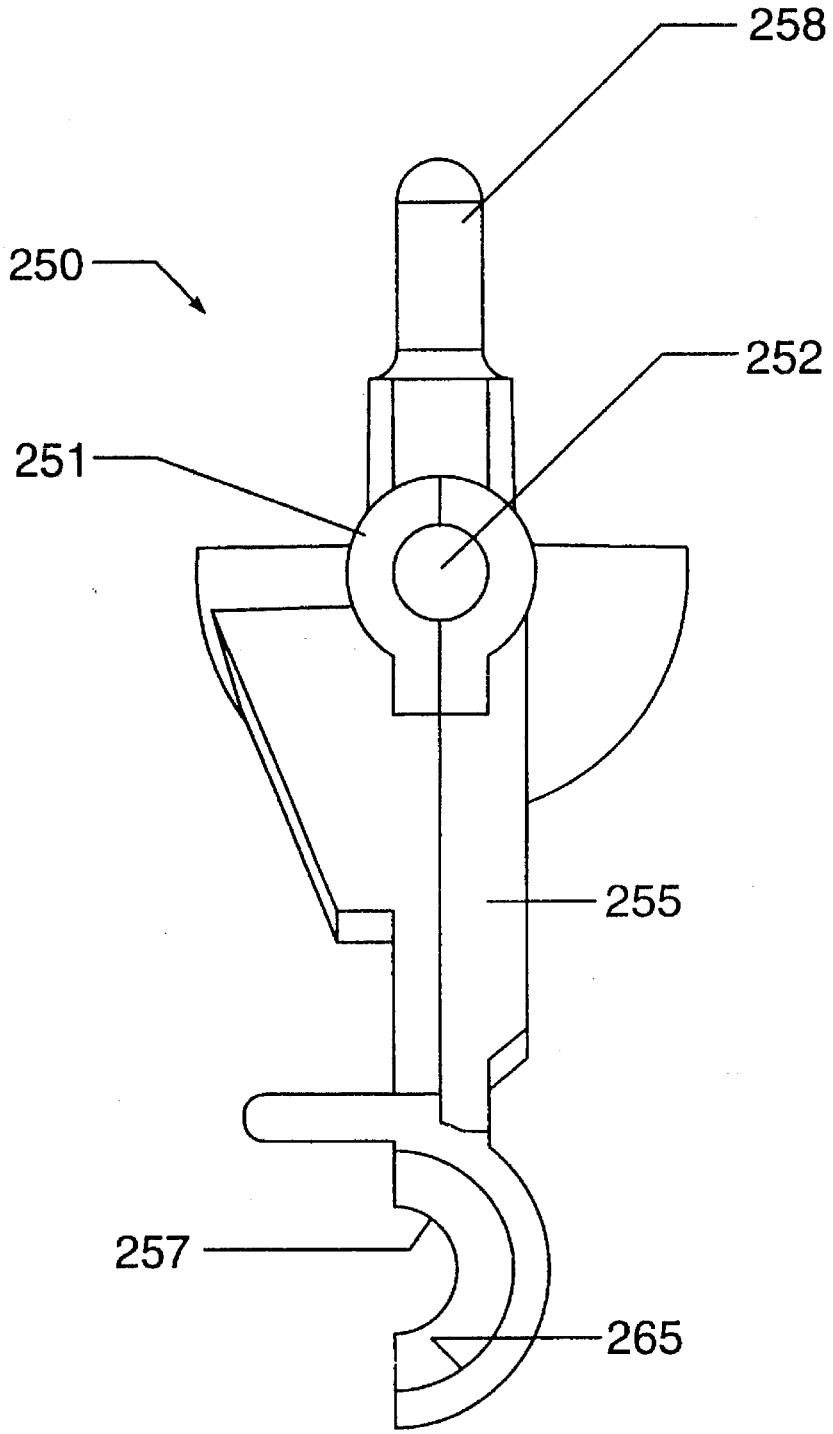
Figure 14A:
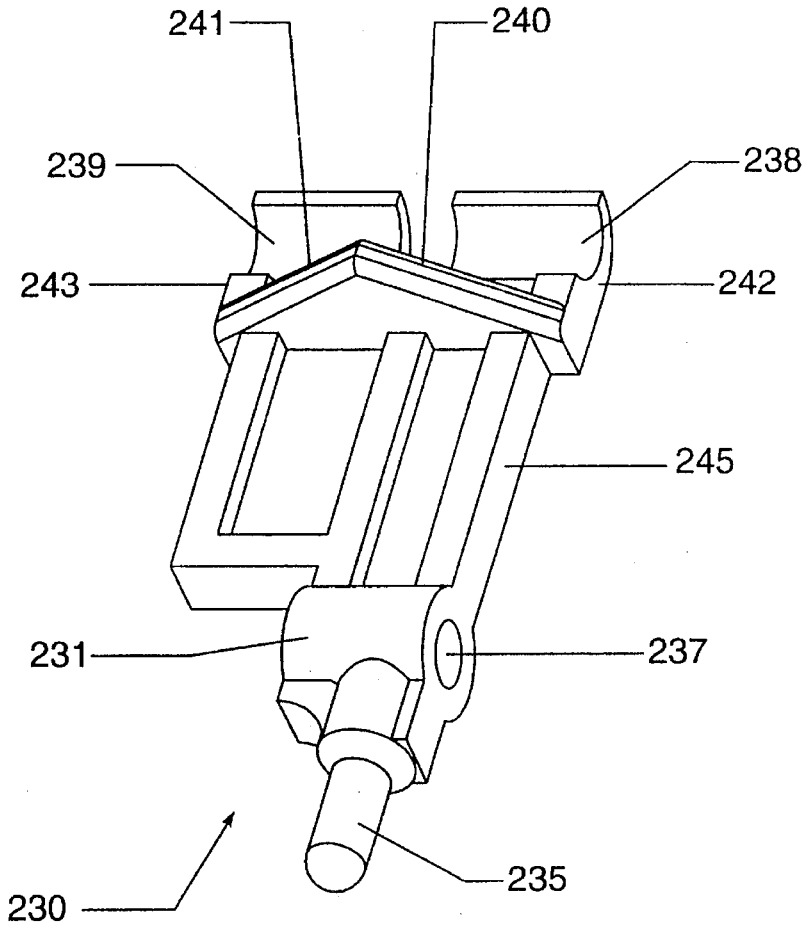
FIGS. 14A–G are perspective, top, bottom, front, rear, left side, and right side views of the separator arm of rear roller assembly of FIGS. 11A and B.
Figure 14D:
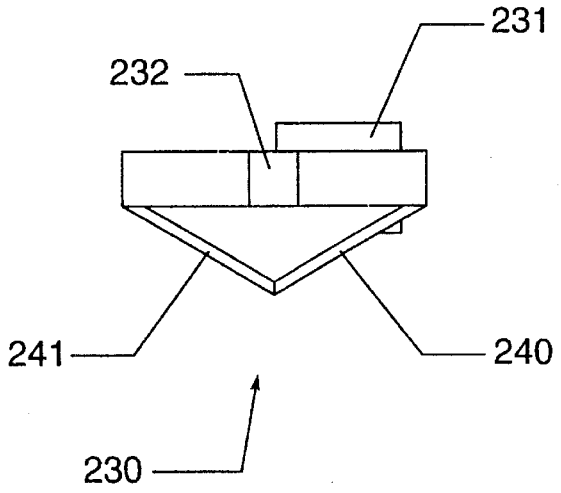
Figure 14E:
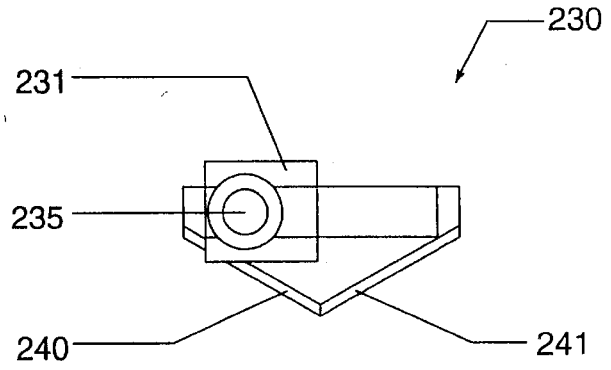
Figure 14G:
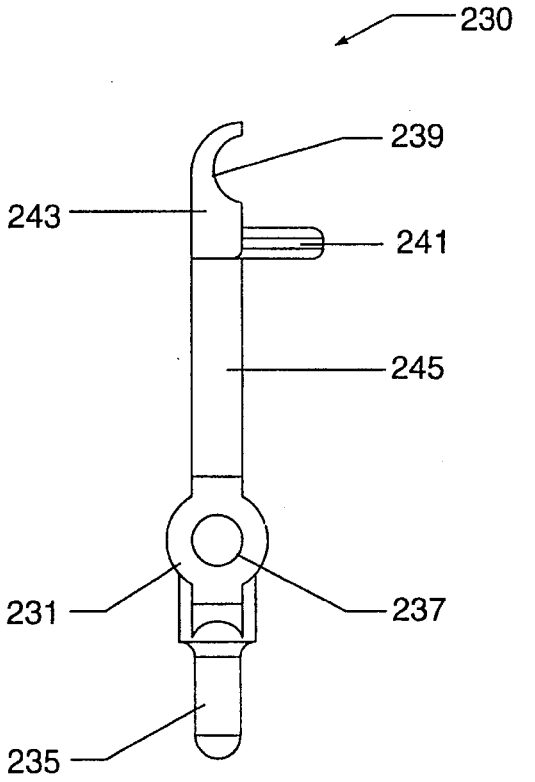
Figure 14B:
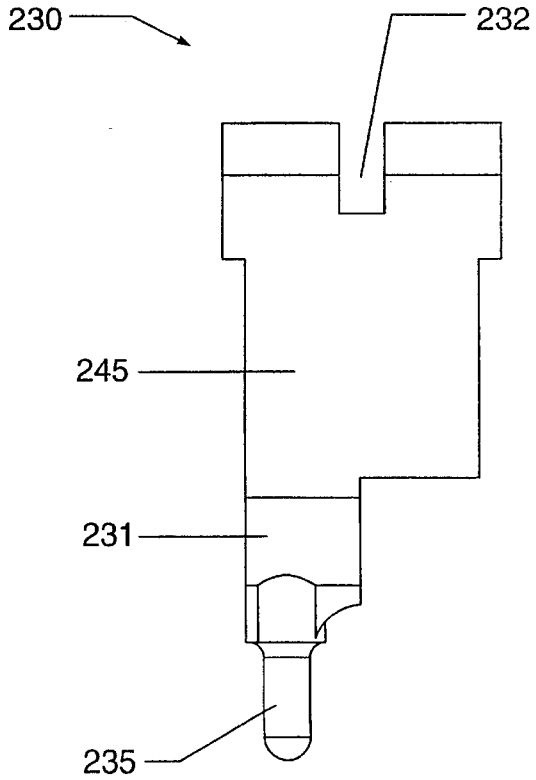
Figure 14C:
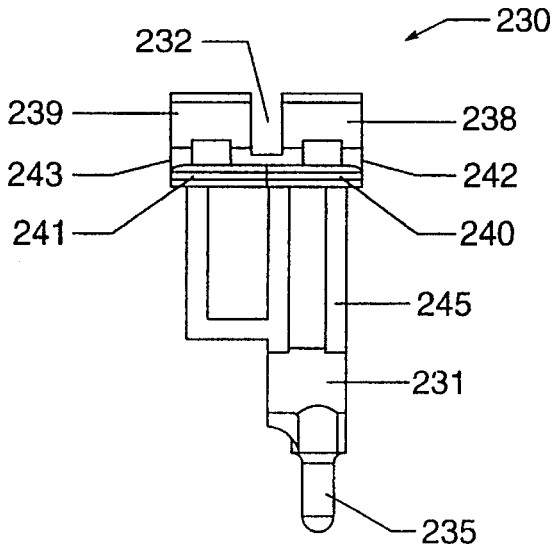
Figure 14F:
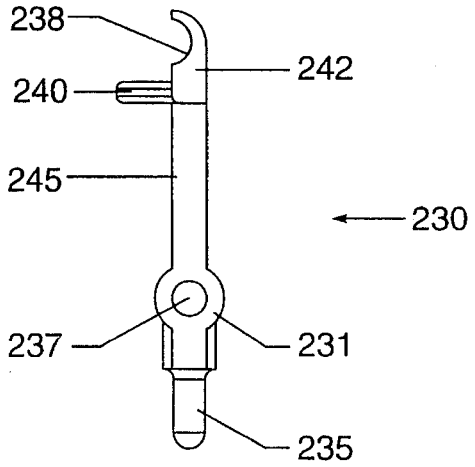
Figure 15B:
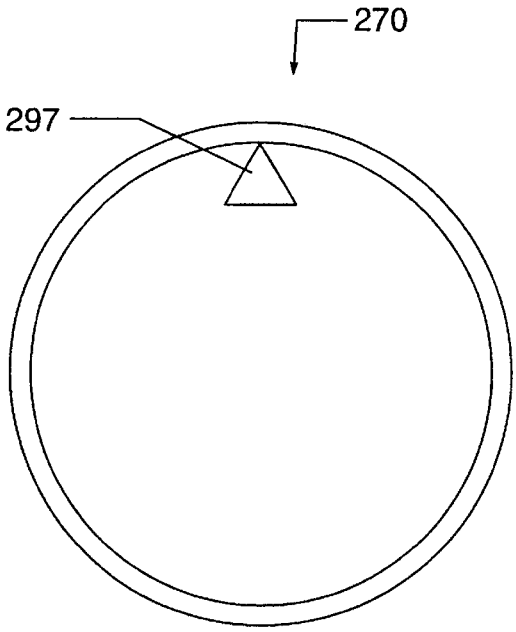
FIGS. 15A–D are perspective, outside end, inside end, and side views of the knob of rear roller assembly of FIGS. 11A and B
Figure 15D:
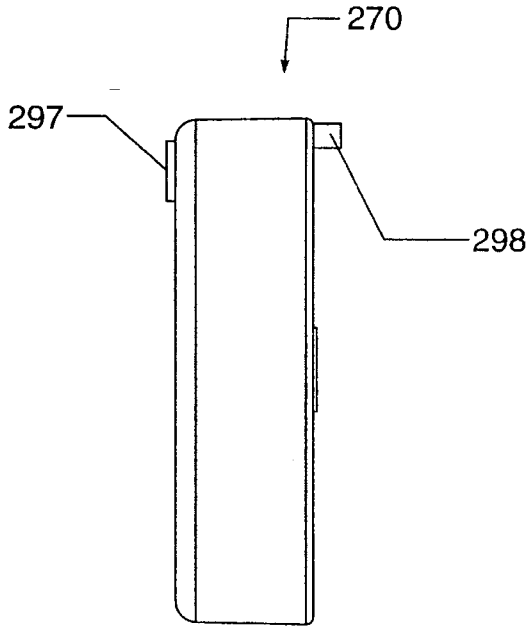
Figure 15A:
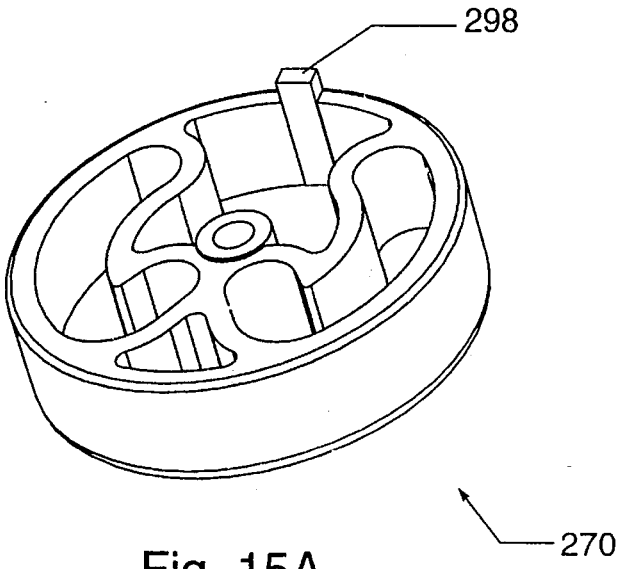
Figure 15C:
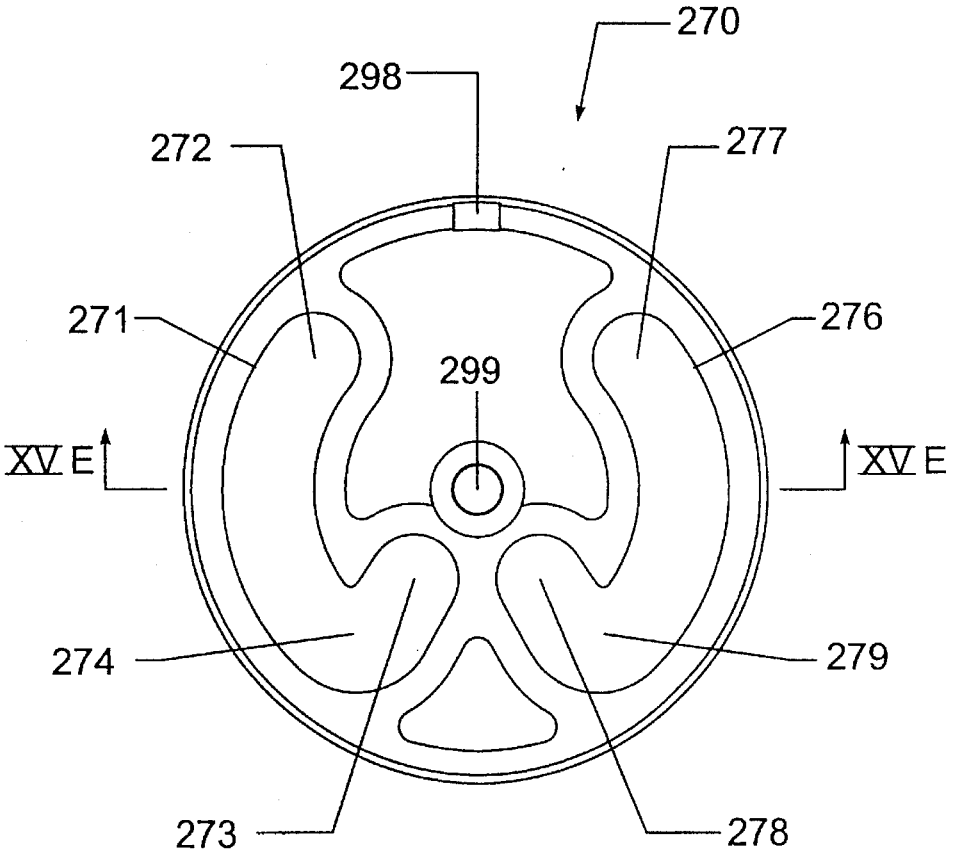
Figure 15E:
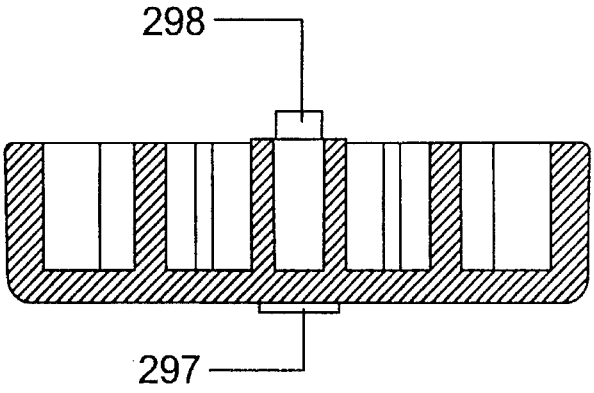
FIG. 15E is a cross-sectional view of the knob of rear roller assembly of FIGS. 11A and B taken along line XVE—XVE in FIG. 15C.
Figure 16A:
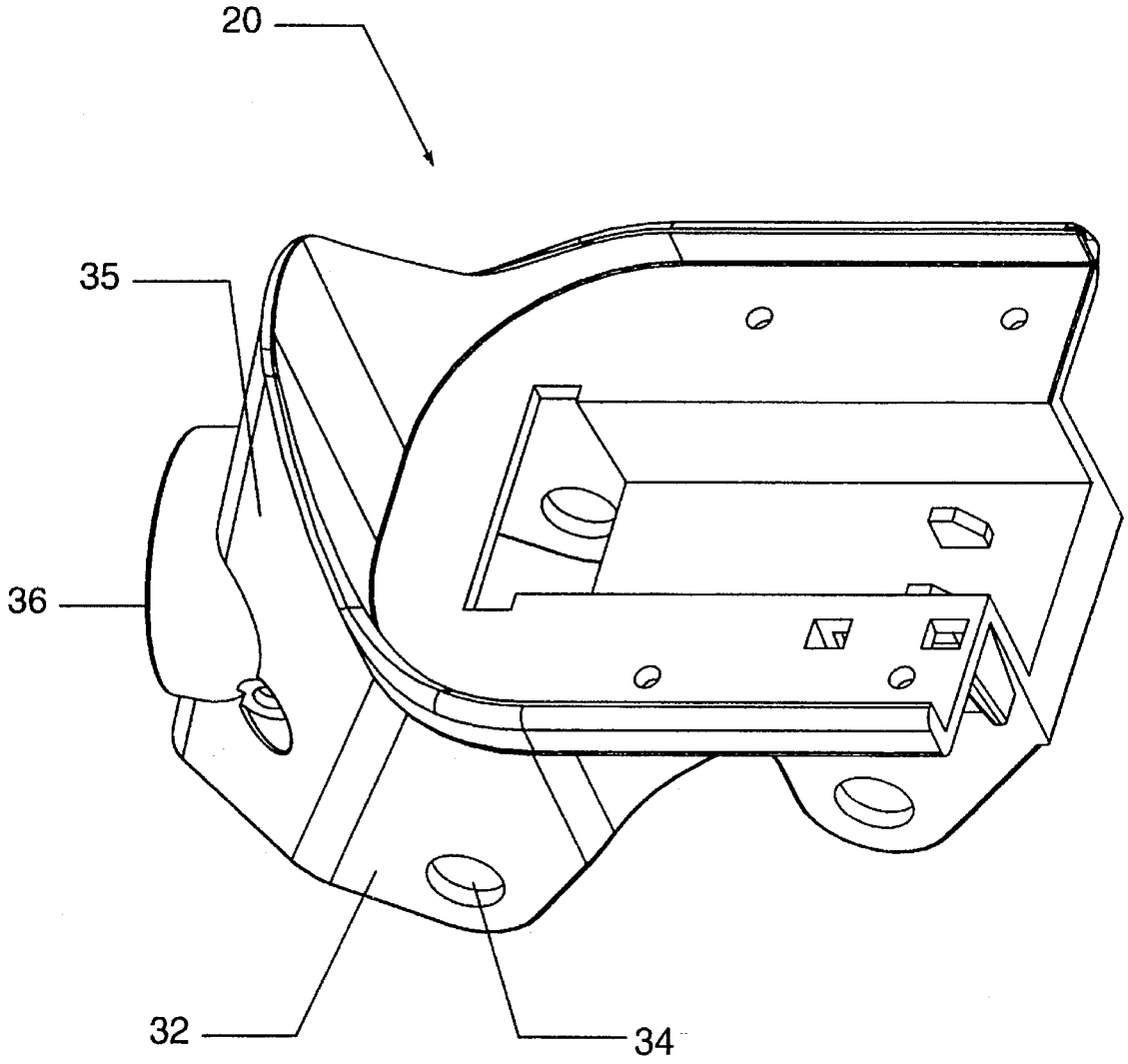
FIGS. 16A–F are perspective, top, bottom, end, left side, and right side views of the rear chassis of FIGS. 11A and B
Figure 16B:
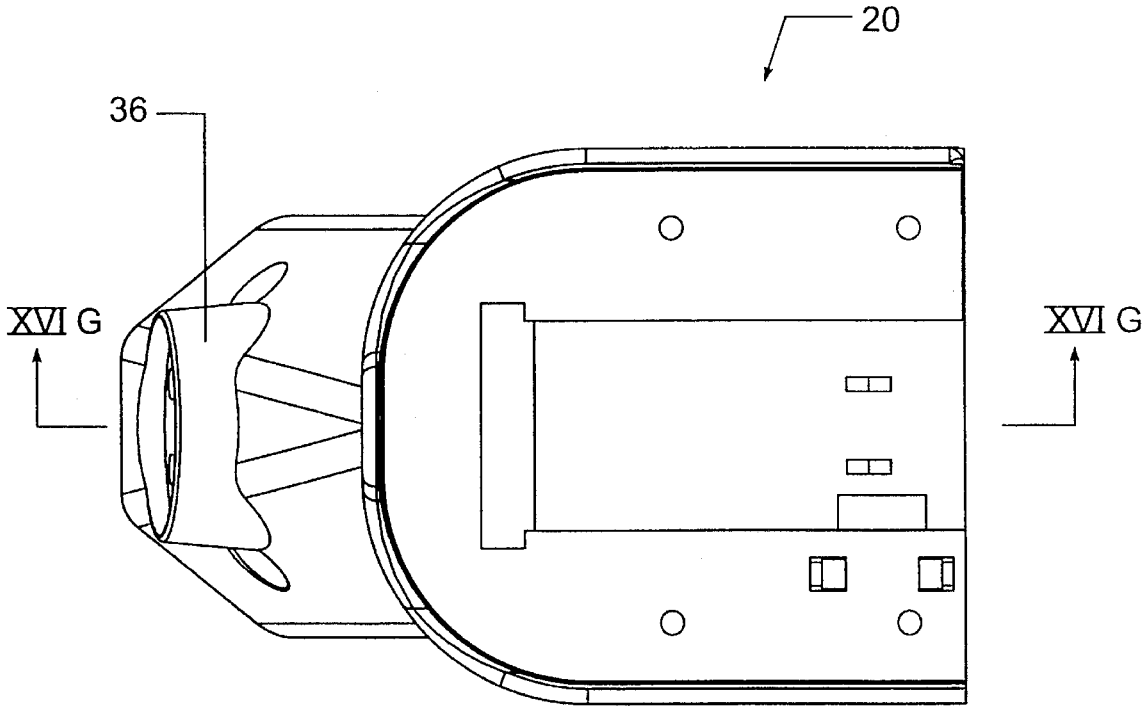
Figure 16C:
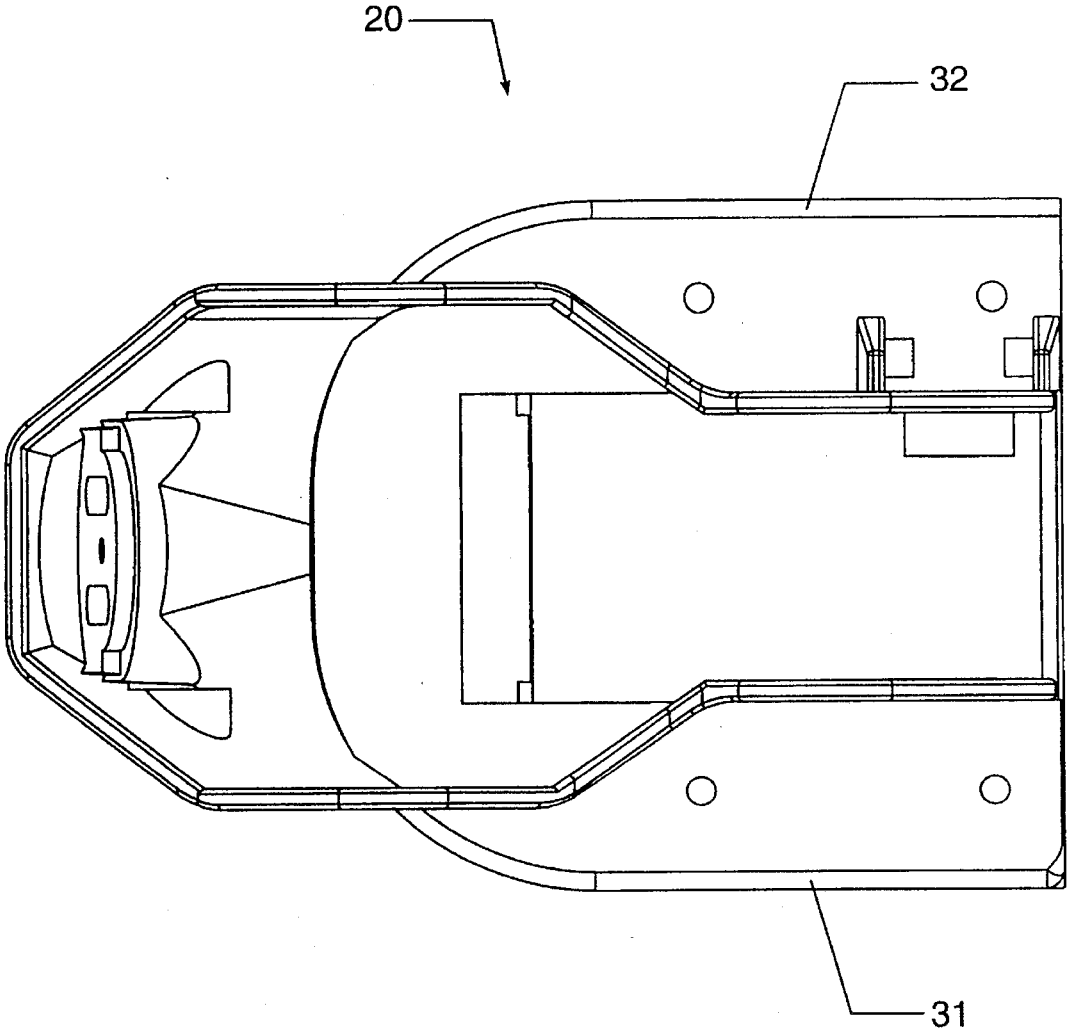
Figure 16D:
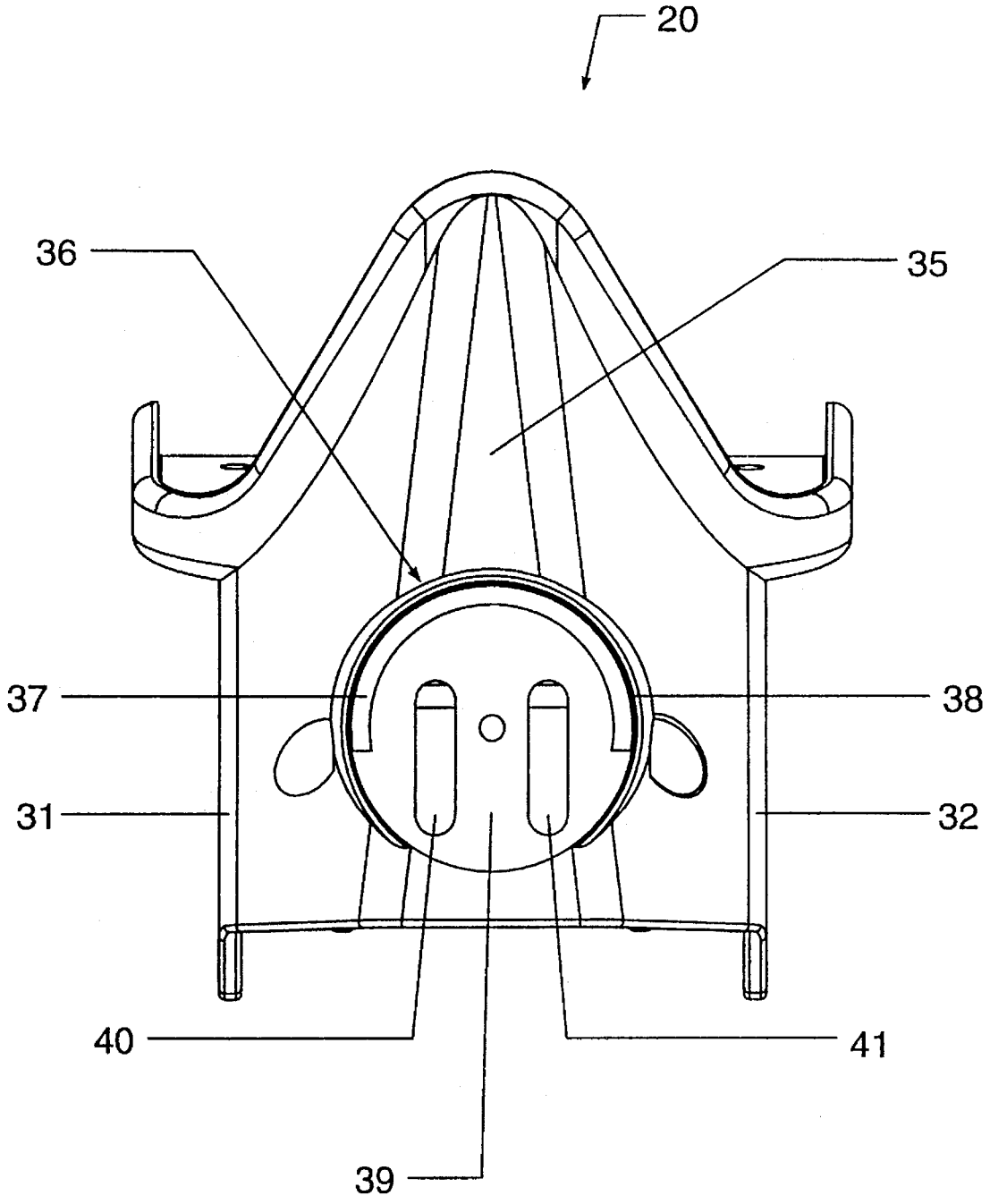
Figure 16E:
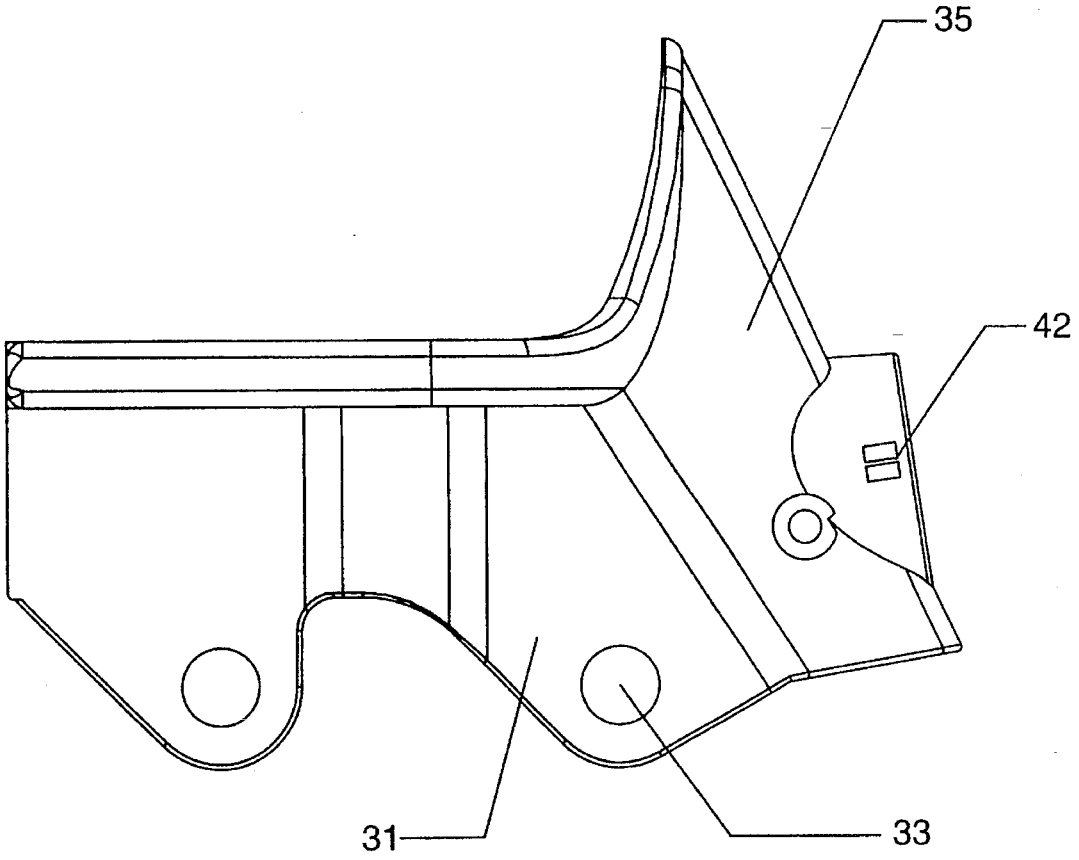
Figure 16F:
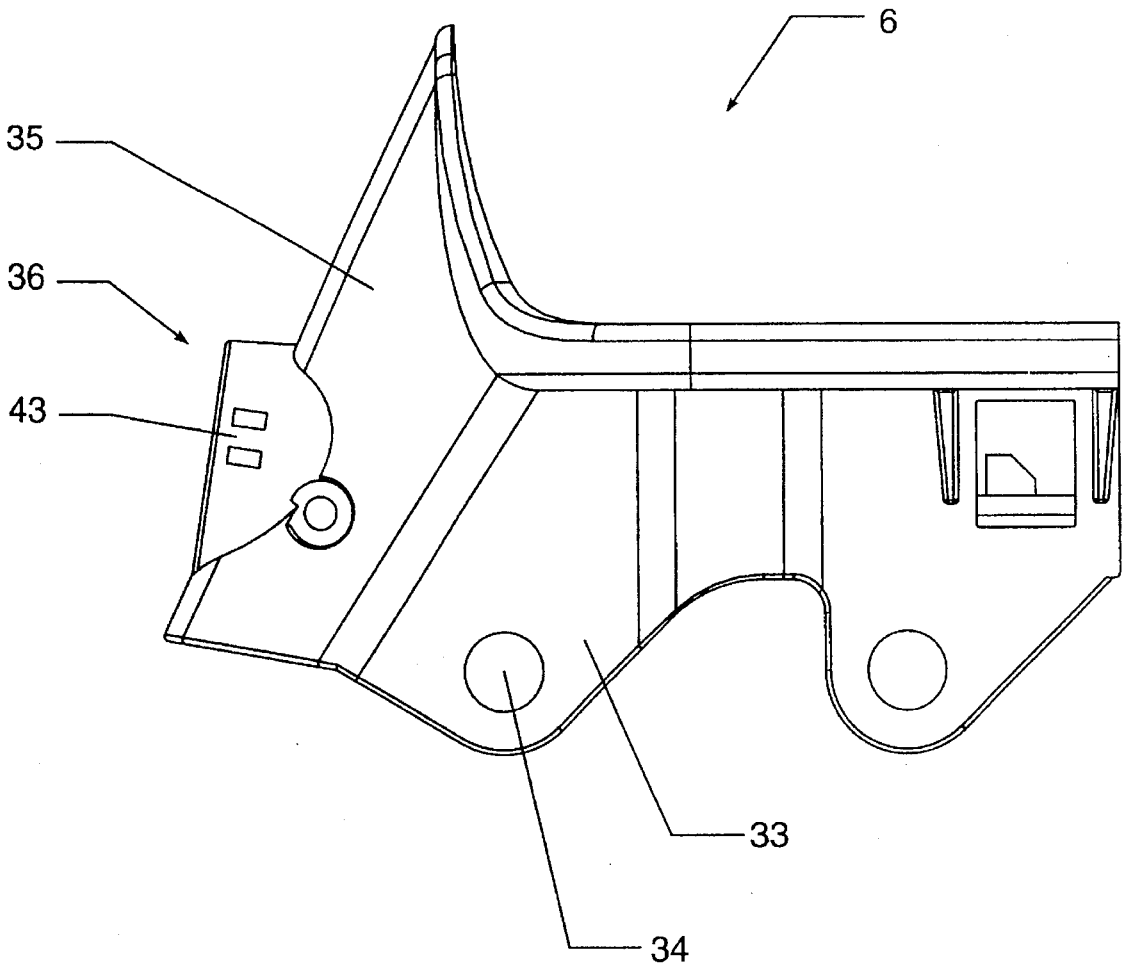
Figure 16G:
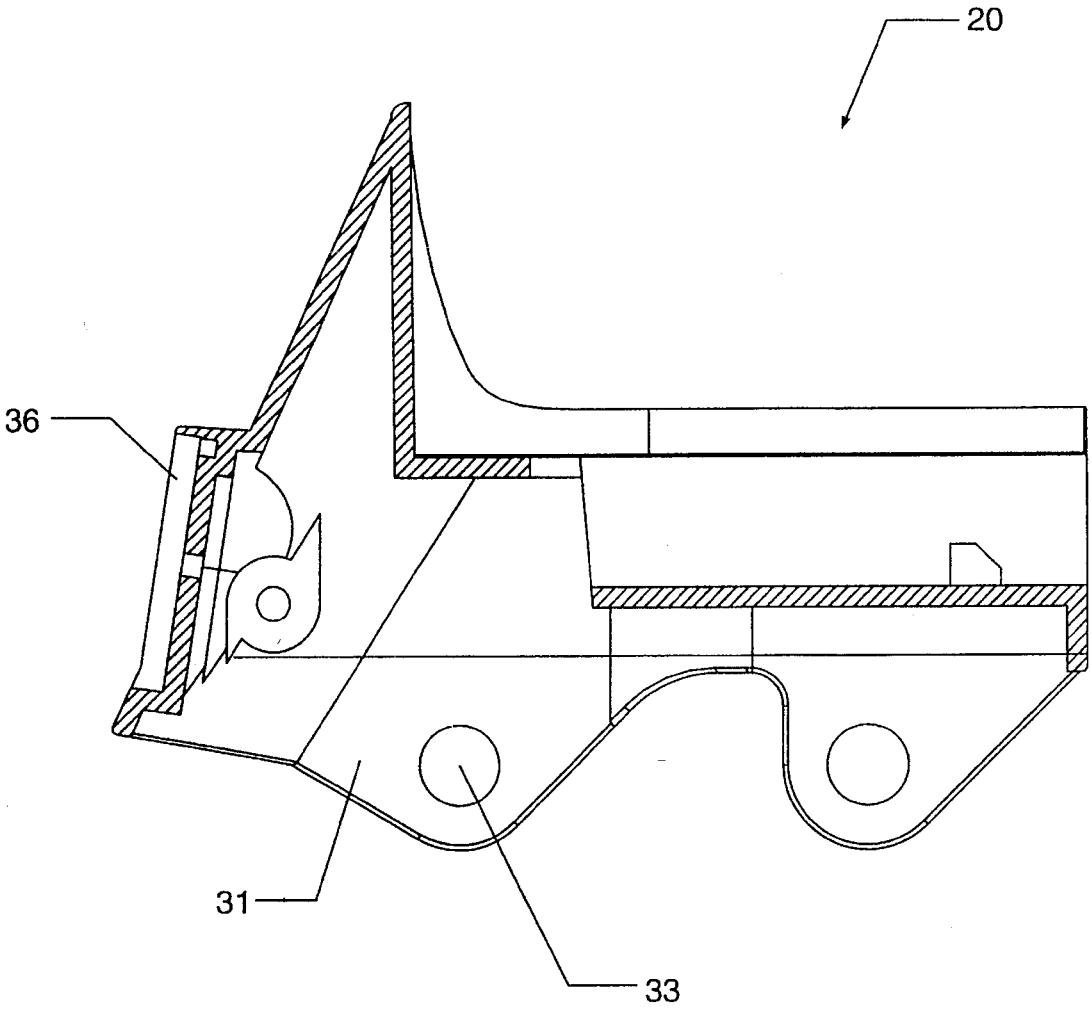
FIG. 16G is a cross-sectional view of the rear chassis of FIGS. 11A and B taken along line XVIG—XVIG in FIG. 16B.
Figure 17B:
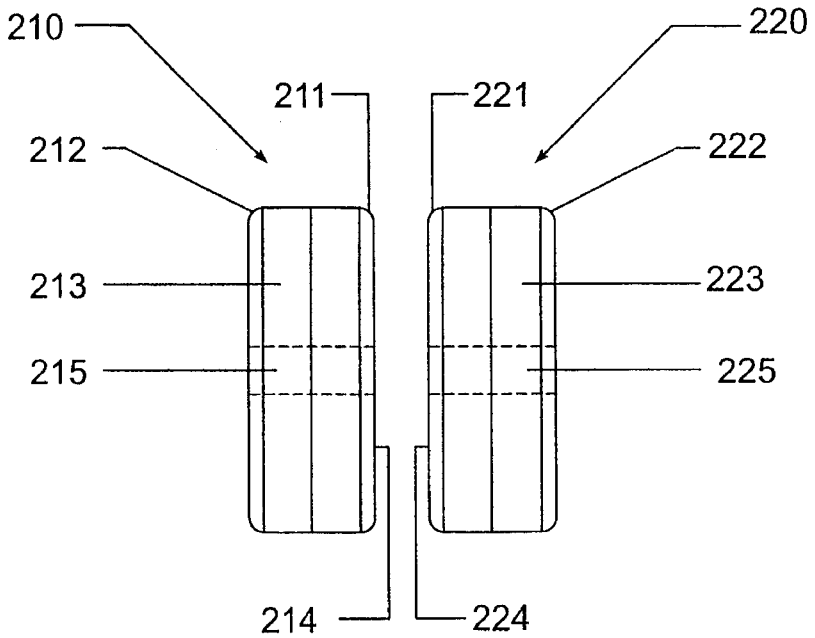
FIGS. 17A–C are perspective, end, and inside views of the rollers of the rear roller assembly of FIGS. 1 1A and B
Figure 17C:
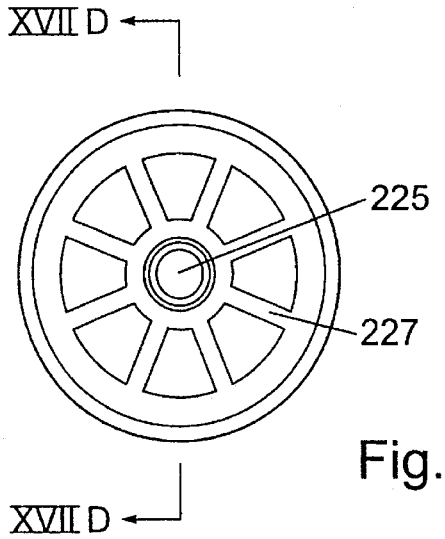
Figure 17D:
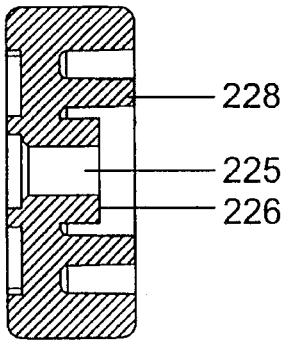
FIG. 17D is a cross-sectional view of the rollers of the rear roller assembly of FIGS. 11A and B taken along line XVIID—XVIID in FIG. 17C.
Figure 17A:
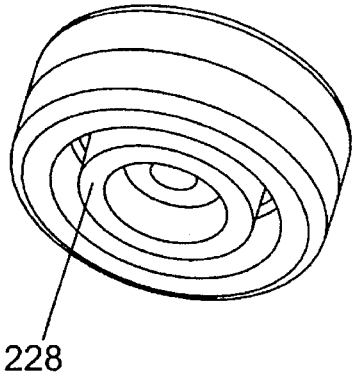
Figure 18:
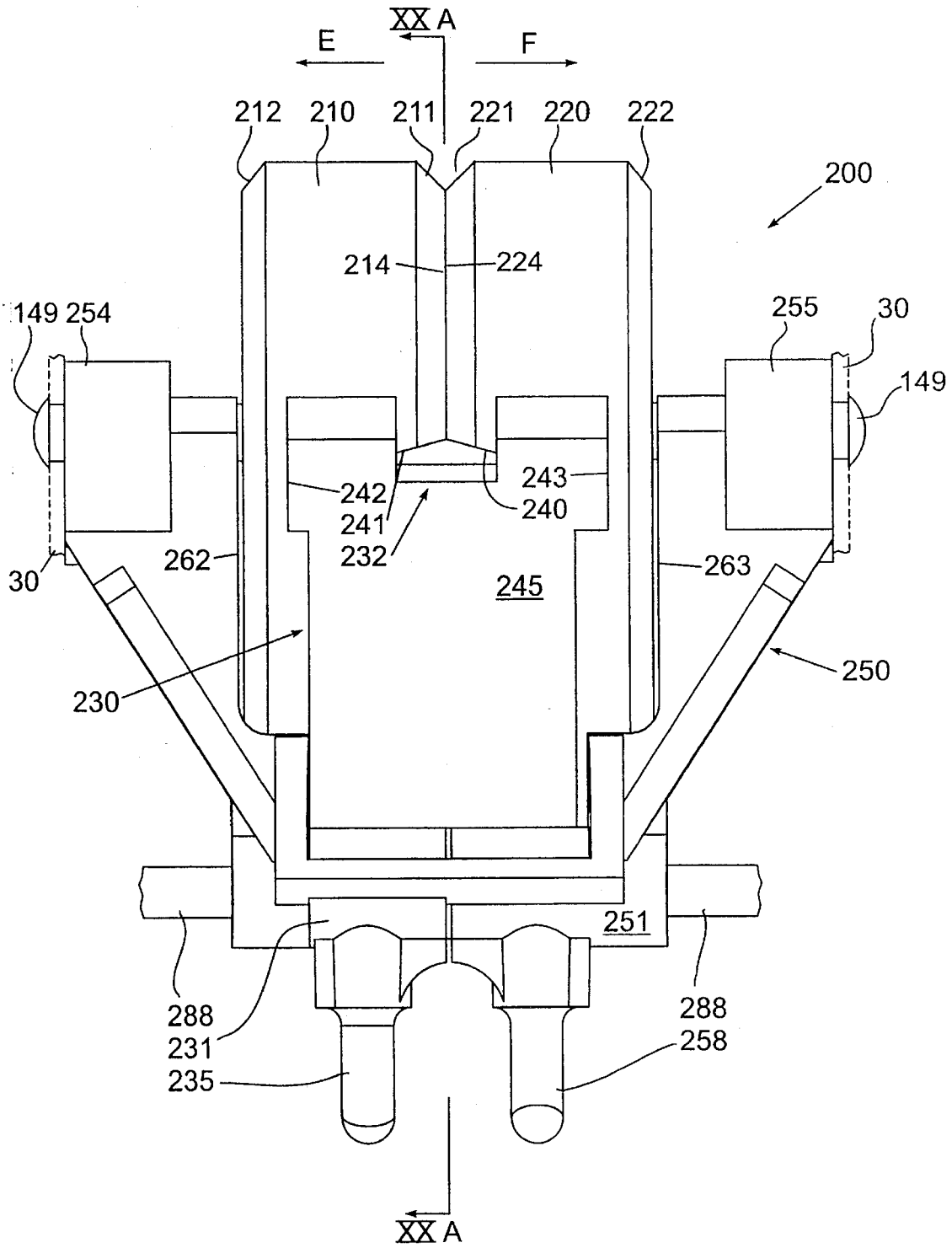
FIG. 18 is a top view of the rear roller assembly of FIG. 12A.
Figure 19:
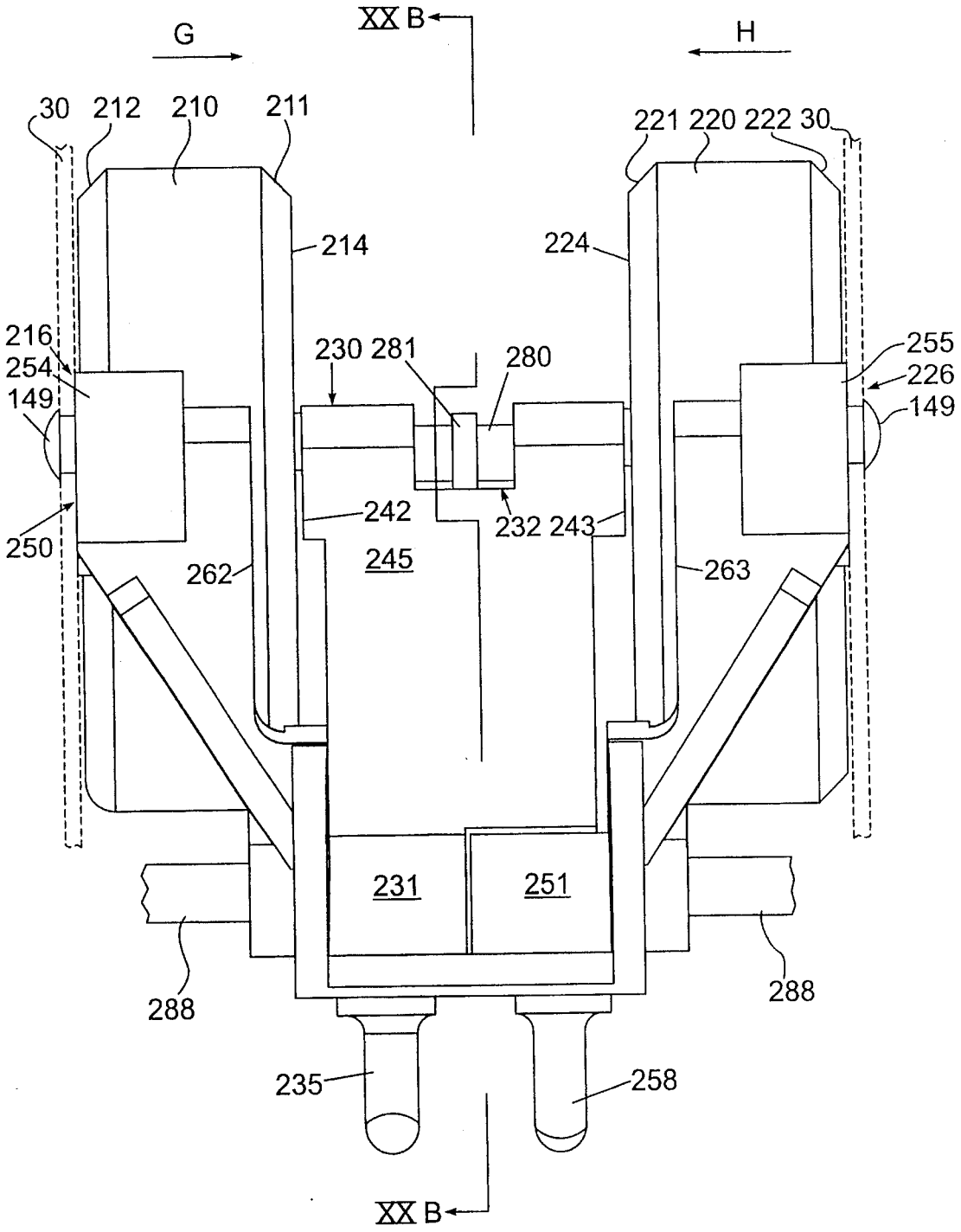
FIG. 19 is a top view of the rear roller assembly of FIG. 12B.
Figure 20A:
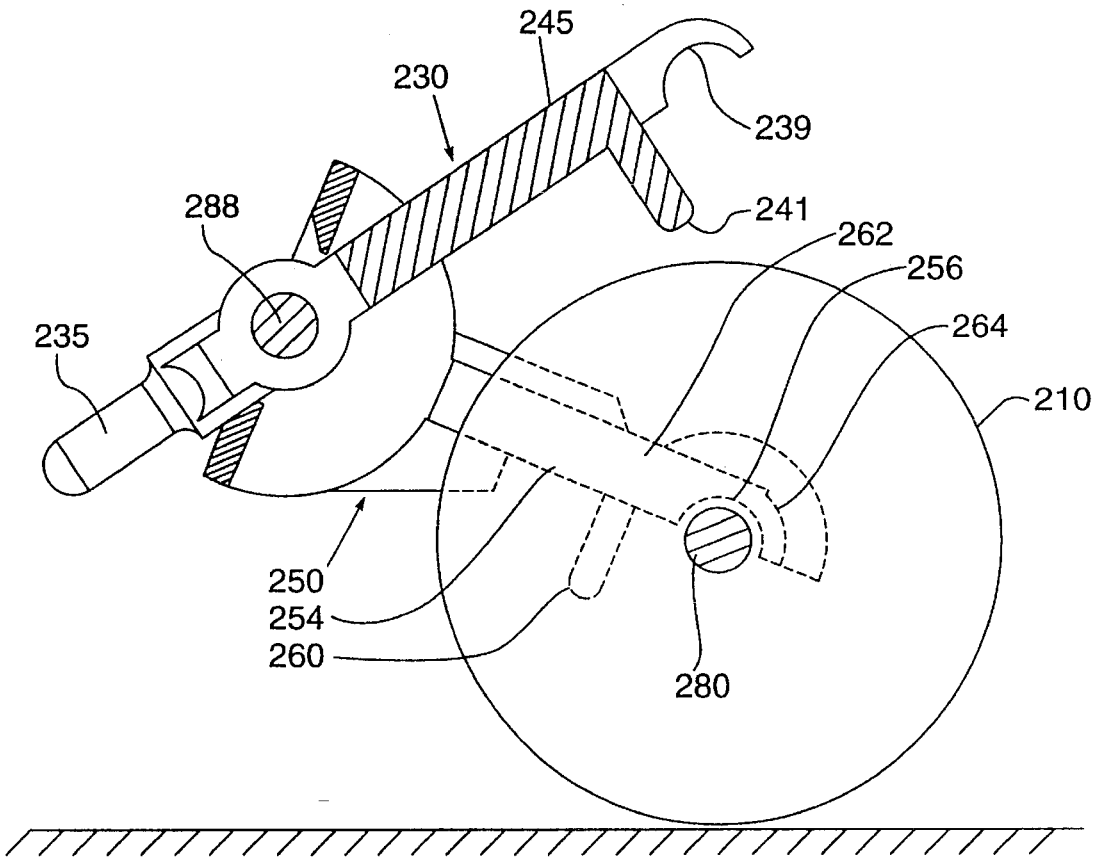
FIG. 20A is a cross-sectional view of the rear roller assembly of FIG. 18 take about line XXA—XXA.
Figure 20B:
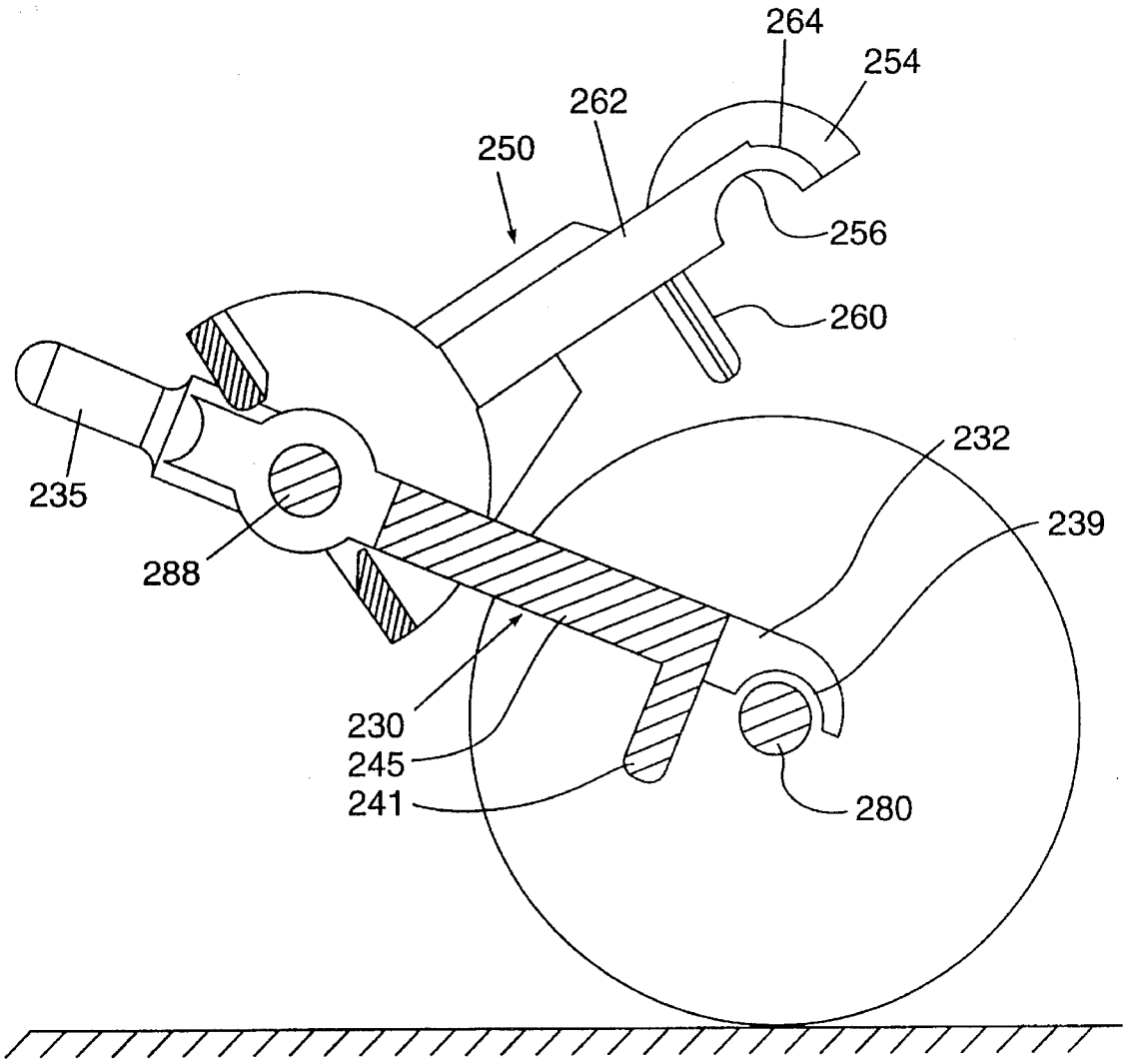
FIG. 20B is a cross-sectional view of the rear roller assembly of FIG. 19 take about line XXB—XXB.

The stability enhancing mechanism of rear roller assembly 200 is configurable in a normal mode as shown in FIGS. 12A, 18 and 20A, or a stable mode as shown in FIGS. 12B, 19, and 20B. In the normal mode, left roller 210 and right roller 220 are positioned at the center of axle 280 and act as a single rear roller and fingers 254, 255 of combine arm 250 are pivoted downward on pivot axle 288 so that axle recesses 256, 257 are adjacent to axle 280 and axle cap recesses 264, 265 are adjacent to axle caps 149. Therefore, left finger 254 and fight finger 255 are positioned on the outside of rollers 210 and 220, respectively so that inside edges 262, 263 of fingers 254, 255 prevent the rollers from sliding outwardly toward their stable mode positions. Engaging end 245 of separator arm 230 is pivoted upward on pivot axle 288 so that it is out of contact with rollers 210, 220.

In the stable mode shown in FIGS. 19 and 20B, rollers 210, 220 are spaced apart on axle 280. Fingers 254, 255 of combine arm 250 are pivoted upward on pivot axle 288 so that they are out of contact with rollers 210, 220. Engaging end 245 of separator arm 230 is pivoted downward on pivot axle 288 so that axle recesses 238, 239 are adjacent to axle 280 and axle rib 281 is disposed in rib gap 232. Therefore, separator arm 230 rides on axle 280 between rollers 210, 220 to prevent the rollers from sliding toward the center of axle 280 into the normal mode. Rollers 210, 220 cannot slide farther apart on axle 280 because outside hubs 216, 226 of rollers 210, 220 abuts against axle caps 149.

Figure 21A:
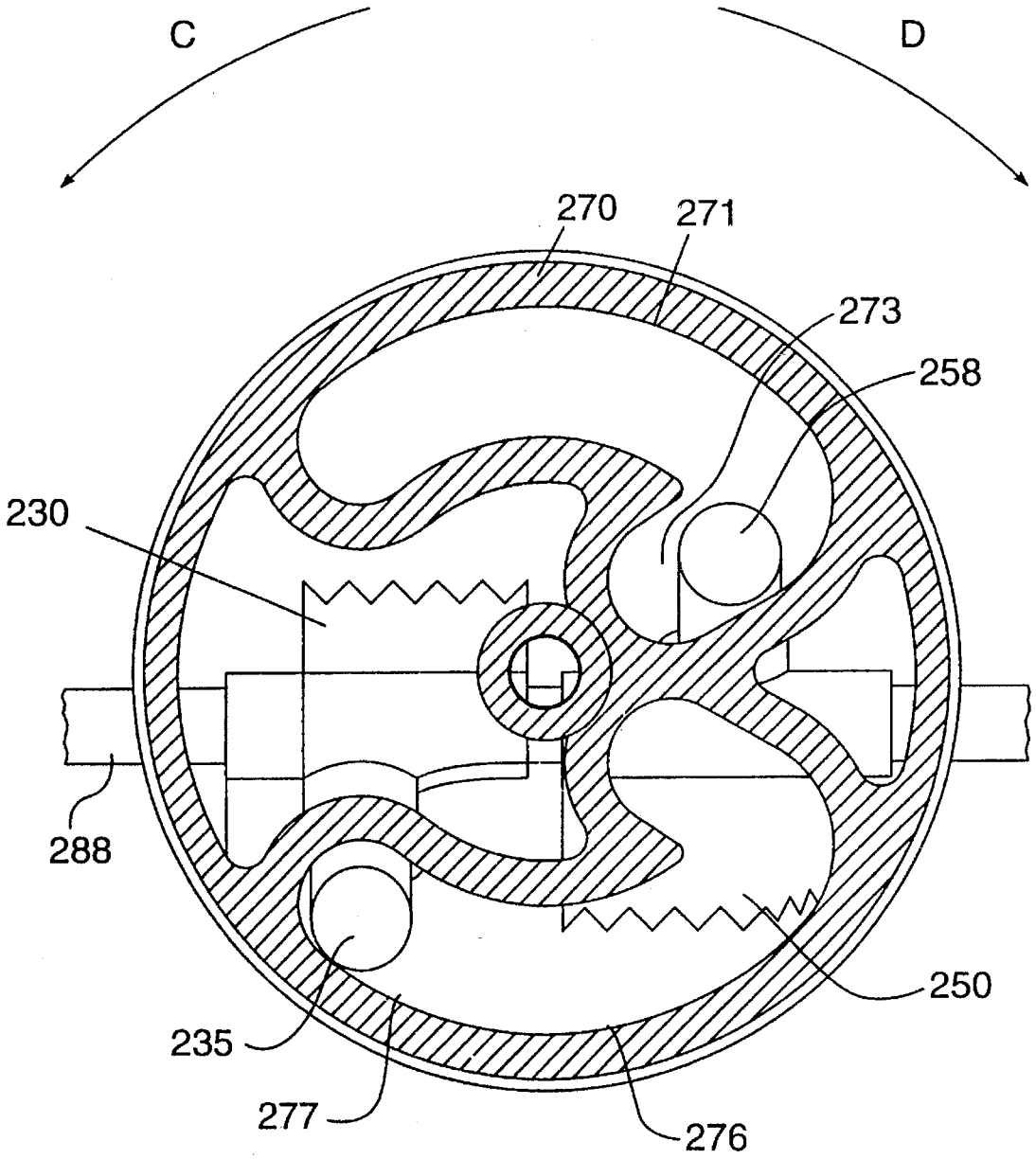
FIGS. 21A–C are partial cross-sectional end views of the rear roller assembly taken along lines XXI—XXI in FIG. 1A.
Figure 21B:
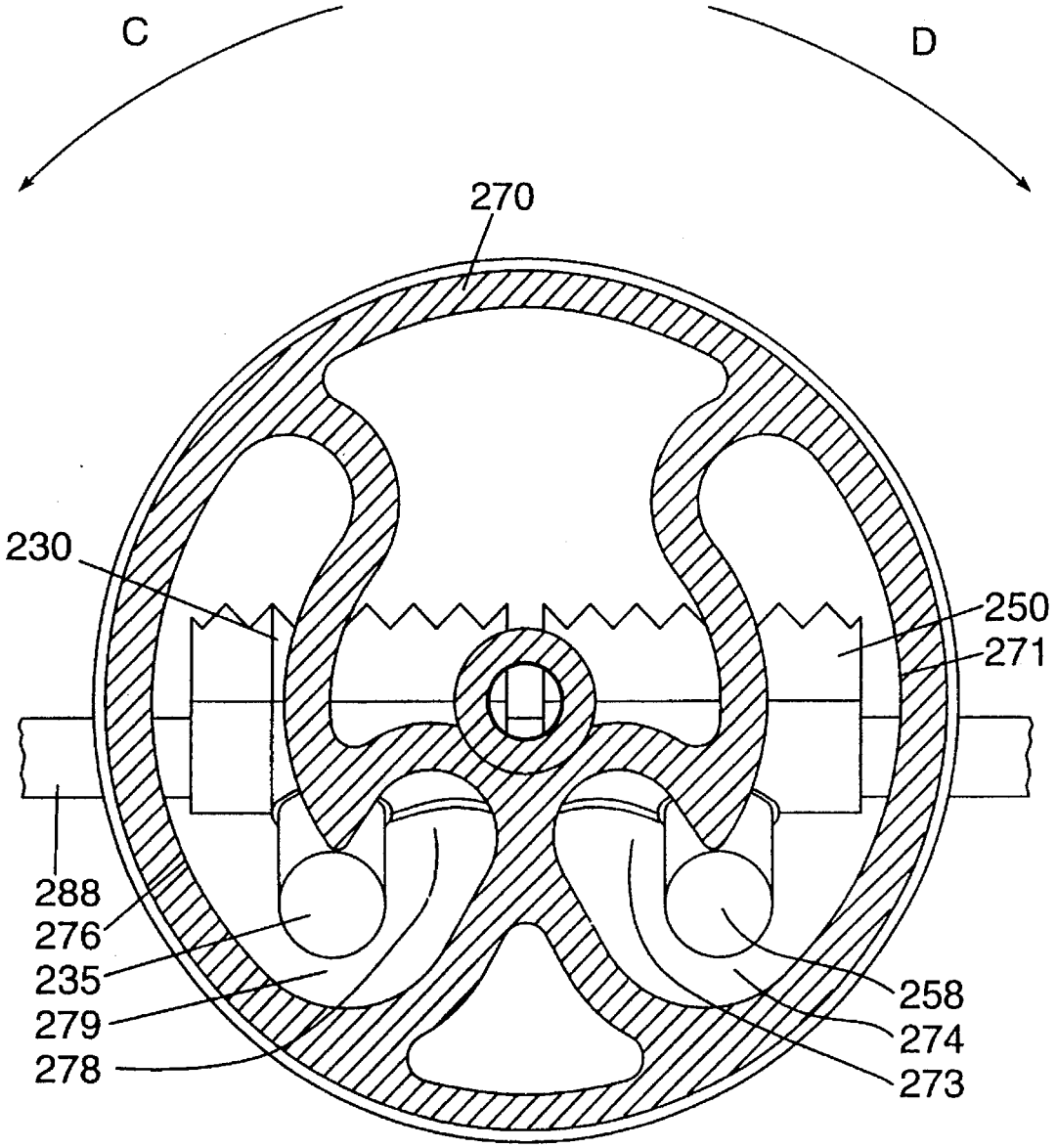
Figure 21C:
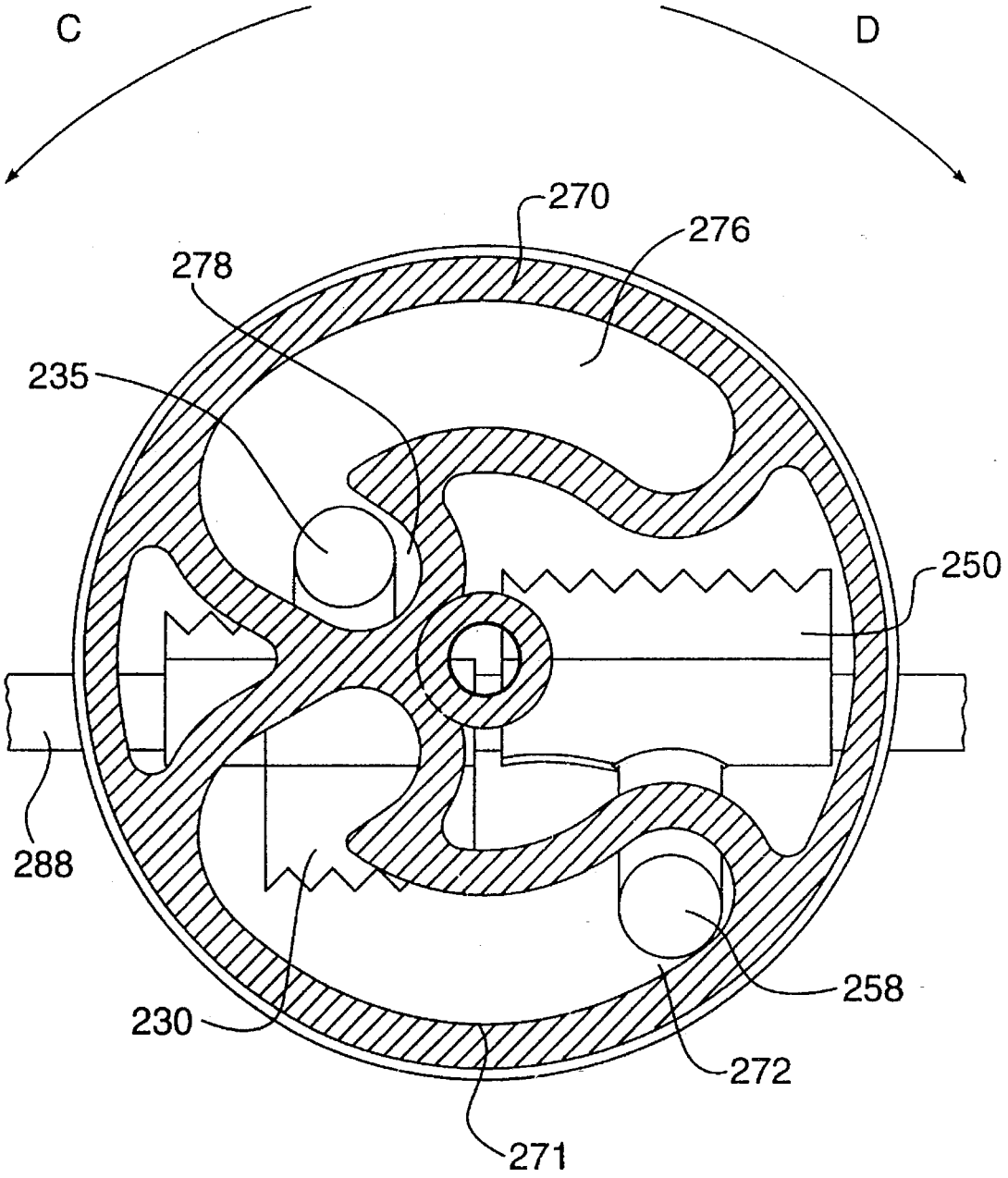

Referring to FIGS. 21A–C, separator control lever 235 of separator arm 230 and combine control lever 258 of combine arm 250 extend rearward of pivot axle 288 and are received by grooves 276 and 271 of knob 270, respectively. FIG. 21A shows knob 270 rotated so that rear roller assembly 200 is in the normal mode. Separator control lever 235 is positioned downward, below the center-line of pivot axle 288 at upper end 277 of separator control groove 276 of knob 270. Consequently, engaging end 245 of separator arm 230 extends upward above the center line of pivot axle 288 so that cam surfaces 240, 241 of separator arm 230 do not contact rollers 210, 220 as shown in FIG. 20A.

To transition the mechanism from the normal to the stable configuration, knob 270 is rotated in the direction of arrow D. Separator control lever 235 will initially remain in substantially the same position while combine control lever 258 of combine arm 250 will be urged downward by the sides of lower end 273 of combine control groove 271 to the positions illustrated in FIG. 21B, where separator control lever 235 and combine control lever 258 are positioned at comer portions 279 and 274 respectively. Since both separator control lever 235 and combine control lever 258 are below the center-line of pivot axle 288, engaging end 245 of separator arm 230 and fingers 254, 255 of combine arm 250 extend upward out of contact with rollers 210, 220. Although rollers 210, 220 are free to slide on axle 280 without interference from either separator arm 230 or combine arm 250, axle rib 281 prevents either roller from inadvertently sliding across the longitudinal center-line of the skate on axle 280.

As knob 270 is rotated farther in the direction of arrow D, separator control lever 235 is urged upward by the sides of lower end 278 of separator control groove 276 to be retained above the center-line of pivot axle 288 in the position shown in FIG. 21C. Consequently, this movement causes engaging end 245 of separator arm 230 to arc downward to a position below the center-line of pivot axle 288. As engaging end 245 of separator arm 230 arcs downward, cam surfaces 240, 241 abut inside corners 211 and 221 of rollers 210, 220, respectively. The downward motion of engaging end 245 of separator arm 230 is thus translated into a lateral force on rollers 210, 220 by cam surfaces 240, 241, in the directions of arrows E and F in FIG. 18. Consequently, rollers 210, 220 will slide along axle 280 in the directions of arrows E and F respectively, urged apart over the length of cam surfaces 240, 241 until inside edges 214, 224 of rollers 210, 220 are outside of outside edges 242, 243 of separator arm 230. Ribs 217, 227 on the inside edges 214, 224 of rollers 210, 220 abut against outside edges 242, 243 of engaging end 245 so that rollers 210, 220 do not inadvertently slide in toward engaging end 245 of separator arm 230 midway through descent. Thus, ribs 217, 227 of roller 210, 220 allow engaging end 245 to descend without striking the inside hubs of rollers 210, 220. Engaging end 245 of separator arm 230 will continue downwards toward axle 280 and until axle recesses 238, 239 rest on axle 280 as shown in FIGS. 19 and 20B. In this configuration, the outside edges 242, 243 of separator arm 230 abut against the hub of inside edges 214, 224 of rollers 210, 220 to keep the rollers from sliding inward into the normal mode.

To transition from the stable to the normal configuration, knob 270 shown in FIG. 21C in the stable mode, is rotated in the direction of arrow C. Combine control lever 258 will initially remain in substantially the same position while separator control lever 235 of separator arm 230 will be urged downward by the sides of lower end 278 of separator control groove 276 to the positions illustrated in FIG. 21B where separator control lever 235 and combine control lever 258 are positioned at corner portions 279 and 274 respectively. Since both separator control lever 235 and combine control lever 258 are below the center-line of pivot axle 288, engaging end 245 of separator arm 230 and fingers 254, 255 of combine arm 250 extend upward out of contact with rollers 210, 220. Therefore, rollers 2 10, 220 are free to slide on axle 280 without interference from either separator arm 230 or combine arm 250. However, as discussed above, although rollers 210, 220 are free to slide on axle 280, axle rib 281 prevents either roller from inadvertently sliding across the longitudinal center-line of the skate on axle 280.

As knob 270 is rotated farther in the direction of arrow C, combine control lever 258 is urged upward by the sides of lower end 273 of groove 271 to be retained above the center-line of pivot axle 288 in the position shown in FIG. 21A. Consequently, fingers 254, 255 of combine arm 250 arc downward to a position below the center-line of pivot axle 288. As fingers 254, 255 of combine arm 250 arc downward, cam surfaces 260 and 261 abut outside corners 212 and 222 of rollers 210, 220, respectively. The downward motion of fingers 254, 255 of combine arm 250 is translated into a lateral force on rollers 210 and 220 by cam surfaces 260, 261, in the directions of arrows G and H respectively in FIG. 19. Consequently, rollers 210, 220 will slide along axle 280 in the directions of arrows G and H respectively, urged together by cam surfaces 260, 261 of combine arm 250 until inside edges 214, 224 of rollers 210, 220 are contiguous. Fingers 254, 255 of combine arm 250 will continue downwards toward axle 280 until axle recesses 256, 257 ride on axle 280 as shown in FIG. 20A. In this configuration, the inside edges 262, 263 of fingers 254, 255 of combine arm 250 abut against outside hubs 216, 226 of rollers 210, 220 to keep the rollers in the stable mode as shown in FIG. 19.

Position indicator markings 42, 43 can be formed in the outer surface of peripheral wall 38 which are indicated by arrow 297 on control knob 270. In this embodiment, knob 270 is rotated so that arrow 297 aligns with marking 42 to indicate to the user that rear roller assembly is in the normal mode (rollers together) or rotated so that arrow 297 aligns with marking 43 to indicate to the user that rear roller assembly is in the stable mode (rollers spaced apart).

Combine arm 250 and separator arm 230 will remain fixed in any mode as set by the user. Since both have substantially the same weight, they both will apply a substantially equal upward force on knob 270 through combine control lever 258 and separator control lever 235. However, since these two forces are opposite in rotative directions, they act to cancel each other out and prevent unwanted movement of the combine arm 250 and separator arm 230. Furthermore, knob 270 could be mounted so that frictional forces resisting rotation or a locking mechanism is used to keep both pivoting members in place.

The components of the rear assembly in this embodiment are formed from plastic, however any sufficiently rigid material could be used to construct the components.

The stability enhancing mechanism is incorporated only on the rear roller assembly of each skate since the added stability provided by employing it on a single roller assembly provides sufficient stability for the child to safely master use of the skate. However, the mechanism could be adapted to any roller or the front and rear rollers to more closely simulate a conventional four wheel roller skate.

The enhanced stability is achieve by laterally displacing the rollers, with respect to each other, to create spaced contact points with the ground to resist the tipping force. By displacing the roller-to-ground contact points to both sides of the longitudinal center-line of the skate, additional lateral stability is created to resist tipping towards either side. Consequently, it is contemplated that any suitable mechanism that selectively displaces the rollers with respect to each other falls within the scop of invention.

The disclosed embodiment illustrates a mechanism with a single control actuator that drives the combine and separator arms simultaneously. Other embodiments could have separate controls for each arm, use a sliding motion (rather than the pivoting motion) for the arms to slide the rollers, or use one arm for each roller to independently control the rollers so that the enhanced stability could be reduced or eliminated in lateral directions in which the user no longer has difficulty in keeping balance.

Although the illustrated embodiment discloses a stability enhancing member having two pivoting member (separator arm 230 and combine arm 250), the invention would also work with one member that is alternately positioned between the rollers or outside the rollers. Also, knob 270 could be replaced with a sliding cam member to change between normal and stable modes.

What is claimed is:

1. A roller skate comprising:

a body;

a roller mounted to said body for rotation in a forward direction and an opposite, reverse direction, and having an outer, rolling surface and an inner surface disposed substantially concentric with, and radially inwardly from, said outer surface;

a ratchet tooth coupled to said roller on said inner surface and projecting radially inwardly with respect to said inner surface to a ratchet tooth inner radius;

a pawl having a guide portion, a pawl arm, and an engaging end;

means for guiding said pawl along a defined pawl path between a first position in which said engaging end is spaced radially inwardly from said ratchet tooth inner radius and a second pawl position in which said engaging end is disposed radially outwardly from said ratchet tooth inner radius, said pawl guide means being disposed at least partially within said inner surface and engaging said guide portion; and a pawl adjuster disposed at least partially outside said outer surface, being movable between first, and second retainer positions, and being coupled to said pawl arm to move said pawl along said pawl path, said first and second retainer positions corresponding to said first and second pawl positions, respectively, said pawl adjuster in said second position allowing movement of said pawl along said pawl path away from said second pawl position in a ratcheting motion to permit said roller to rotate in only one of said forward and reverse directions.

2. The roller skate of claim 1, wherein said pawl guide means includes two generally parallel, opposed, exterior pawl guide side faces oriented generally parallel to said pawl path; and said guide portion of said pawl includes two generally parallel arms slidably engaging said pawl guide side faces, said engaging end being disposed at an end of one of said guide portion arms.

3. The roller skate of claim 1, further comprising an axle on which said roller is concentrically mounted, said pawl guide means being mounted on said axle.

4. The roller skate of claim 1, wherein:

said body has an indicia portion bearing an indicium for each of said retainer positions; and said pawl adjuster includes a body and an actuator having an aperture therethrough disposed adjacent said indicia portion with the one of said indicia corresponding to the presently selected pawl adjuster position being visible through said aperture.

5. The roller skate of claim 1, wherein:

said body has a plurality of slots, one corresponding to each of said retainer positions; and said pawl adjuster has a flexible tab engageable with said slots to resist movement of said pawl adjuster away from a selected one of said retainer positions.

6. The roller skate of claim 1, wherein said pawl adjuster includes a camming surface to urge said pawl from said second position to said first position.

7. The roller skate of claim 1, further comprising a rib coupled to said body parallel to said pawl path to guide said pawl along said pawl path.

8. The roller skate of claim 1, wherein:

said pawl adjuster is movable to a third retainer position, said pawl adjuster in said third retainer position preventing movement of said pawl away from said second pawl position to thereby prevent said roller from moving in either said forward or reverse directions.

9. The roller skate of claim 1, wherein said pawl moves along a substantially linear, vertical pawl path.

10. The roller skate of claim 1, wherein said pawl adjuster moves along a substantially linear, horizontal path between said first and second positions.

11. An in-line roller skate having a roller assembly, comprising:

a body;

an axle coupled to said body;

first and second rollers rotatably mounted on said axle;

said first roller being slidably mounted on said axle for lateral movement between a first position adjacent said second roller and a second position spaced from said second roller;

a separator arm coupled to said body and selectively moveable between said first and second roller for sliding said first roller along said axle from said first position to said second position; and a combine arm coupled to said body for sliding said first roller along said axle from said second position to said first position.

12. The in-line roller skate of the claim 11 wherein said separator arm and said combine arm are coupled to said body for pivotal movement.

13. The in-line roller skate of claim 11, wherein:

said first roller includes a laterally inner and radially outer corner; and said separator arm includes a first outwardly directed cam surface selectively engageable with said laterally inner and radially outer corner of said first roller to urge said first roller to said second position.

14. The in-line roller skate of claim 11, wherein:

said first roller includes a laterally outer and radially outer corner; and said combine arm includes a first inwardly directed cam surface selectively engageable with said laterally outer and radially outer corner of said first roller to urge said first roller to said first position.

15. The in-line roller skate of claim 14, further comprising:

an axle cap coupled to said axle, limiting outward lateral movement of said first roller on said axle; and said combine arm has an axle cap recess for receiving said axle cap and an axle recess for receiving said axle.

16. The in-line roller skate of claim 11, wherein:

said axle includes a radial axle rib, and said first roller includes a laterally inner side abutting said rib in said first position.

17. A roller assembly for an in-line skate, comprising:

a body;

an axle assembly mounted to said body having an axle; and first and second rollers rotatably and slidably mounted on said axle for movement along said axle between a normal mode in which said first and second rollers are adjacent and a stable mode in which said first and second rollers are spaced apart; and a control assembly mounted to said body and having a combine arm for selectively engaging said first and second rollers to urge said first and second rollers together to convert the roller assembly from said stable mode to said normal mode; and a separator arm for selectively engaging said first and second rollers to urge said first and second rollers apart to convert the roller assembly from said normal mode to said stable mode.

18. The roller of claim 17 wherein:

each of said first and second rollers has an outer rolling surface;

said control assembly further includes a pivot axle spaced from said roller axle;

said separator arm includes a separator body portion and an engaging end, said body portion being pivotally coupled to said pivot axle, said engaging end being moveable between a first position in which said engaging end is disposed adjacent said roller axle and between said rollers and a second position in which said engaging end is disposed radially outside said outer rolling surfaces of said rollers; and said combine arm includes a combine body portion and a combine finger, said body portion being pivotally coupled to said pivot axle, said combine finger being moveable between a first position in which said combine finger is disposed adjacent said axle and a second position in which said combine finger is disposed radially outside said outer rolling surfaces of said rollers.

19. The roller of claim 18, wherein:

said combine finger is in said second position and said engaging end is in said first position when said roller is in said stable mode; and said engaging end is in said second position and said combine finger is in said first position when said roller is in said normal mode.

20. The in-line skate of claim 18, wherein:

said combine arm has a combine control lever;

said separator arm has a separator control lever; and said control assembly further includes an actuator coupled to said control levers and moveable between a first actuator position, corresponding to said stable mode, in which said engaging end is in said first position and said combine finger is in said second position, and a second actuator position, corresponding to said normal mode, in which said combine finger is in said first position and said engaging end is in said second position, movement of said actuator between said first and second actuator positions urging said engaging end and said combine finger toward said respective positions.

21. An in-line roller skate comprising:

a body;

a first roller assembly mounted to said body having only a single, first roller which is rotatable in a first, forward direction and a second, reverse direction; and means for controlling rotation of said roller, said controlling means having a first, free wheeling mode in which said controlling means permits rotation of said first roller in said forward and reverse directions, and a second, forward only mode in which said controlling means prevents rotation of said first roller in said reverse direction; and a second roller assembly mounted to said body having:

an axle; and second and third rollers mounted on said axle;

a separator arm coupled to said body for selectively engaging said second and third rollers to slide said second and third rollers along said axle between a first configuration in which said second and third rollers are adjacent each other and a second configuration in which said second and third rollers are spaced apart.

22. The in-line roller skate of claim 21, wherein said controlling means further comprises a third, full stop mode in which said controlling means prevents rotation of said first roller in either said forward or reverse directions.

23. A roller skate comprising:

a body;

an axle coupled to said body;

a roller mounted on said axle for rotation in a forward direction and an opposite reverse direction and having an outer rolling surface, an inner surface concentric with, and disposed radially inwardly from, said outer rolling surface, a left edge and a right edge;

a ratchet tooth coupled to said roller and disposed between said left and right edges and radially within said outer rolling surface, and projecting radially inwardly to a ratchet tooth inner radius;

a pawl having a pawl tongue and a pawl arm, said pawl being movable between a first position in which said pawl tongue is spaced radially inwardly from said ratchet tooth inner radius and a second position in which said pawl tongue is disposed radially outwardly from said ratchet tooth inner radius;

said pawl tongue being substantially disposed between said left and right edges of said roller and radially inside said inner surface;

said pawl arm being substantially disposed between said left and right edges of said roller and radially outside said outer rolling surface; and a pawl adjuster coupled to said pawl arm and controlling movement of said pawl, said pawl adjuster permitting ratcheting engagement of said pawl tongue with said tooth when said pawl is in said second position, thereby permitting said roller to rotate in only one of said forward and reverse directions.

24. The roller assembly of claim 23, wherein said pawl adjuster is disposed substantially between said left and right edges of said roller and radially outside said outer roller surface.

25. An in-line roller skate having a roller assembly, comprising:

a body;

an axle coupled to said body;

first and second rollers rotatably mounted on said axle;

said first roller being slidably mounted on said axle for lateral movement between a first position adjacent said second roller on said axle and a second position spaced from said second roller on said axle;

a separator arm coupled to said body and at least partially disposed between said first roller and said second roller when said first roller is in said second position;

means for sliding said first roller along said axle from said first position to said second position; and means for sliding said first roller along said axle from said second position to said first position.

26. An in-line roller skate having a roller assembly, comprising:

a body;

an axle coupled to said body;

first and second rollers rotatably mounted on said axle;

said first roller being slidably mounted on said axle for lateral movement between a first position adjacent said second roller and a second position spaced from said second roller; and a combine arm coupled to said body to selectively engage said first roller to slide said first roller along said axle from said second position to said first position.

27. An in-line roller skate having a roller assembly, comprising:

a body;

an axle coupled to said body;

first and second rollers rotatably mounted on said axle;

said first roller being slidably mounted on said axle for lateral movement between a first position adjacent said second roller and a second position spaced from said second roller; and a separator arm coupled to said body to selectively engage said first roller to slide said first roller along said axle from said first position to said second position.

* * * * *